US008181787B2

(12) United States Patent
Klos

(10) Patent No.: US 8,181,787 B2
(45) Date of Patent: May 22, 2012

(54) SYSTEM AND METHOD OF PACKAGING

(76) Inventor: Kimberly T. Klos, Carlsbad, CA (US)

( * ) Notice: Subject to any disclaimer, the term of this patent is extended or adjusted under 35 U.S.C. 154(b) by 128 days.

(21) Appl. No.: 12/319,531

(22) Filed: Jan. 8, 2009

(65) Prior Publication Data

US 2009/0188833 A1 Jul. 30, 2009

Related U.S. Application Data

(60) Provisional application No. 61/023,396, filed on Jan. 24, 2008.

(51) Int. Cl.
*B65D 81/05* (2006.01)

(52) U.S. Cl. ..... 206/583; 206/462

(58) Field of Classification Search ..... 206/461, 206/471, 521, 583, 591, 594, 462, 463
See application file for complete search history.

(56) References Cited

U.S. PATENT DOCUMENTS

| | | | | | |
|---|---|---|---|---|---|
| 3,692,264 | A * | 9/1972 | Burkhard et al. | ..... | 206/583 |
| 4,432,456 | A * | 2/1984 | Ovadia et al. | ..... | 206/566 |
| 4,606,460 | A * | 8/1986 | Luray | ..... | 206/583 |
| 4,618,069 | A * | 10/1986 | Quong | ..... | 220/23.4 |
| 5,967,327 | A * | 10/1999 | Jones | ..... | 206/583 |
| 6,006,917 | A * | 12/1999 | Loeffler | ..... | 206/583 |
| 6,073,761 | A * | 6/2000 | Jones | ..... | 206/583 |
| 6,880,706 | B2 * | 4/2005 | Braconnot et al. | ..... | 206/583 |
| 2008/0223750 | A1 * | 9/2008 | McDonald et al. | ..... | 206/583 |
| 2010/0031868 | A1 * | 2/2010 | Suda et al. | ..... | 116/216 |

* cited by examiner

*Primary Examiner* — Luan K Bui
(74) *Attorney, Agent, or Firm* — Roy L Anderson; Wagner, Anderson & Bright, P.C.

(57) ABSTRACT

A packaging assembly is disclosed. The packaging assembly is easily assembled and disassembled for convenient use and provides suspension of an enclosed article by way of an arched structure providing protection from impact, shock and vibration. This suspension package and method is called KLOS Pak.

32 Claims, 25 Drawing Sheets

SYSTEM AND METHOD OF PACKAGING

CROSS-REFERENCE TO RELATED APPLICATIONS

This application claims the benefit of provisional patent application Ser. No. 61/023,396, filed Jan. 24, 2008 by the present inventor.

FEDERALLY SPONSORED RESEARCH

Not Applicable.

SEQUENCE LISTING OR PROGRAM

Not Applicable.

BACKGROUND

1. Field of the Disclosure

The present disclosure is related to protective packaging and methods. In particular, to a suspension packaging system and method that suspends an article within a container.

2. Description of the Related Art

Packaging an enclosed article is an art and a science including various requirements of protection, promotion, law, logistics, manufacturing, and materials handling all combined into one. While the functions of a package are various and may include the ability to contain, carry, dispense, identify, and communicate, very rarely can one packaging structure achieve all functions and therefore a combination of more than one packaging structures are combined into a packaging system in order to meet all requirements of an article. Three broad categories cover the scope of a packaging system, primary, secondary, and tertiary packaging. While a primary or first packaging structure such as a formed rigid or semi-rigid retail package such as a blister, skin, or clamshell can decorate and promote or encourage purchase of an enclosed article, a secondary or second packaging structure may be required such as wraps, inserts, liners, foam, pads, or other materials to limit movement within an outer container for transportation and warehousing. To further protect an article from the environment of shock, vibration, and compression, a tertiary or third packaging structure such as an outside container crate, or bulk pack may be required. A packaging system therefore, can quickly become bulky and costly, and forbid one or more desired functions in exchange for the necessary function or primary purpose of a package, to protect an article, especially where an article is fragile and can be best protected when suspended within a container.

There are several suspension packages such as Suspension Packaging U.S. Pat. Nos. 5,388,701 and 5,894,932 and 5,975,307 that suspend articles inside a container, however, they are limited in materials such as they use corrugated which is a material widely used for containment and not as a protective cushioning. A frame is used to sandwich the article between flexible films and suspend the articles in a container. This hammock like configuration leaves the articles susceptible to vibration and the potential to reach resonance, causing damage.

This limits the protection of the article from sinusoidal and random vibration in transportation, where the article bounces up and down with the elasticity of the film hammock configuration while in the container. Even though the suspension feature places the article within the container to protect it from impacts to the outside walls of the container, the article and/or components of an article will still receive g forces and may reach resonance while in transportation and become damaged. Therefore, where articles such as a wine glass would be protected in one of these suspension packages, an electronics article may not. In addition, these suspension packages are hard to assemble if received flat, and bulky if received already assembled causing a high price in warehousing, transportation, and assembly.

Although the need for some structural support has been recognized as found in Retention Packaging such as U.S. Pat. Nos. 5,678,695 and 7,150,356, there is now the limitation of protection from too much packaging contact with the article. In attempting to satisfy the need for structural support the opposite occurs from that of the suspension package that allows space between an impact and the article. If too much packaging material is in contact with an article, shock and vibration travel to the product through the package because there is no space between the impact and the article, and again, while certain articles may do well with a Retention Packaging System, many won't, limiting the number of articles the Retention Packaging can protect.

The present disclosure resolves these issues by suspending an article within a container, keeping it from receiving forces applied to the outside walls of the container, providing structural support by using an arch structure to minimize the contact area, securing it from movement within the packaging system, and providing enough spring in the packaging system to provide cushioning during an impact, drop, and vibration in transportation.

In addition to those primary functions of a packaging system, the present disclosure has unlimited benefits of ease of assembly and dispensing due to the generally planar materials used to form an arch for suspending an article. The planar materials offer low cost in shipping, warehousing, and handling. Thus, constructing a packaging system from planar material that can be left in a flat, compact configuration until it is needed, results in much more efficient storage space.

In addition to those functions of a packaging system, the present disclosure has the benefits of protecting articles from dust, dirt, and moisture.

In addition to those functions of a packaging system, the present disclosure has the benefits of unlimited decoration and communication for retail and gifting. This feature is simply not present in current Suspension and Retention Packaging Systems that focus on the primary functions of protecting the articles they contain.

In addition to those functions of a packaging system, the present disclosure has the benefits of unlimited materials. Several materials and combinations of materials can be used to achieve functions and features that any article would require. Thus, increasing the amount, kinds, and types of articles that can utilize the present disclosure. Because articles are different from another amount, kind, or type of article, so are the characteristics and fragileness, requiring different functions and properties from a packaging system. The present disclosure will be able to satisfy many more requirements than the current Suspension and Retention Packaging Systems as well as be able to receive new materials such as biodegradable materials as they are developed, thus providing a plurality of materials to properly protect and provide unlimited decoration for articles requiring advertising, marketing, and gifting, while being lower in overall costs at the same time.

SUMMARY OF THE DISCLOSURE

The scope of the present disclosure is defined by the appended claims, and nothing in this summary is intended limit those claims.

One aspect of at least one of the illustrative embodiments disclosed herein includes the realization that arch structure of material can be configured to provide positioning, cushioning, and a suspending function within the container. This particular aspect provides several advantages over the available art to provide the following objects:

To provide a package which suspends an article within a container.

To provide a package which protects an article from dust and dirt.

To provide a package which protects an article from shock and vibration.

To provide a package which comprises a plurality of materials.

To provide a package which comprises a plurality of decoration.

To provide a package which provides low cost of warehousing, transportation, and assembly.

To provide a package which displays and communicates well for retail and gifting.

To provide a package that provides a plurality of functions such as to protect, contain, carry, dispense, identify, and communicate an article.

Other objects, advantages, and features will become more readily apparent to those skilled in the art and upon consideration of the following detailed description of the illustrative embodiments and drawings, the disclosure not being limited to any particular preferred embodiments.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
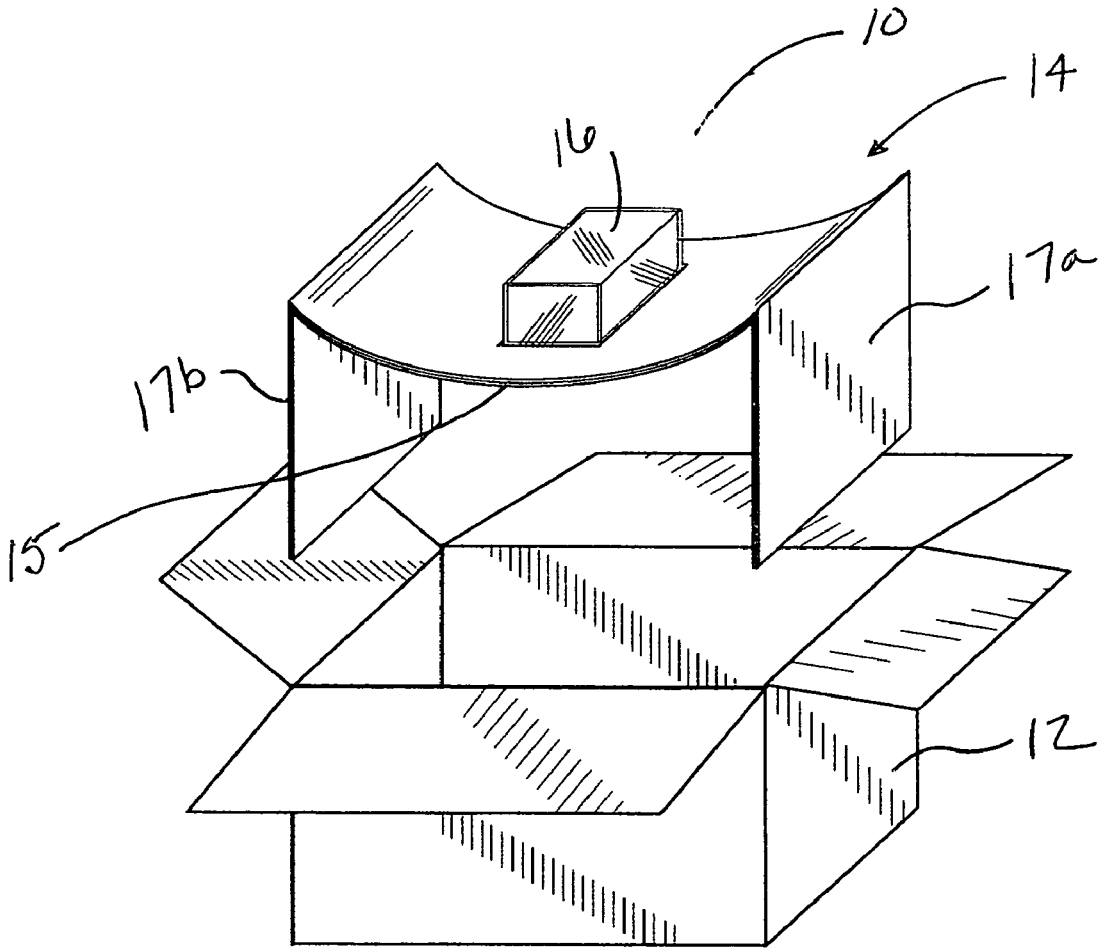
FIG. 1 is a perspective view of an illustrative embodiment of a package assembly.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method processes.

Referring now to FIG. 1, there is shown an illustrative embodiment of a package assembly 10 in accordance with the principles of this disclosure. The package assembly 10 may provide a container 12 and a packaging assembly 14 with at least one arched member 15 with an arched contour that is anomalous to the contour of article 16, for suspending and positioning an article 16 within container 12. The arched member 15 may comprise vertical portions 17*a* and 17*b* disposed on opposing ends of the arched member 15. The arched member 15 also may suspend the article 16 away from the inside surfaces of the container 12.

The packaging assembly 14 in the illustrated embodiment may be held in an arched state by the corresponding sides of the container 12. Alternatively, the arched member 15 may be formed so as to remain in an arched form without external force. Alternatively, the packaging assembly 14 may be formed so as to remain in an arched form without external force [See, e.g. FIG. 2*c*]. Desirably, the arched member 15 may be resilient for optimally suspending an article 16 in a predetermined manner to respond to anticipated loading. Alternatively, the packaging assembly 14 may be resilient for optimally suspending an article 16 in a predetermined manner to respond to anticipate loading [See, e.g. FIG. 2*a*]. The vertical portions 17*a* & 17*b* may be sized to correspond to the corresponding dimension (e.g., vertical height) of container 12. The vertical portions 17*a* & 17*b* may also be fixedly attached to container 12, as can be determined by those skilled in the art, as well as the vertical portions 17*a* & 17*b* can be removably attached to container 12.

Figure 2A:
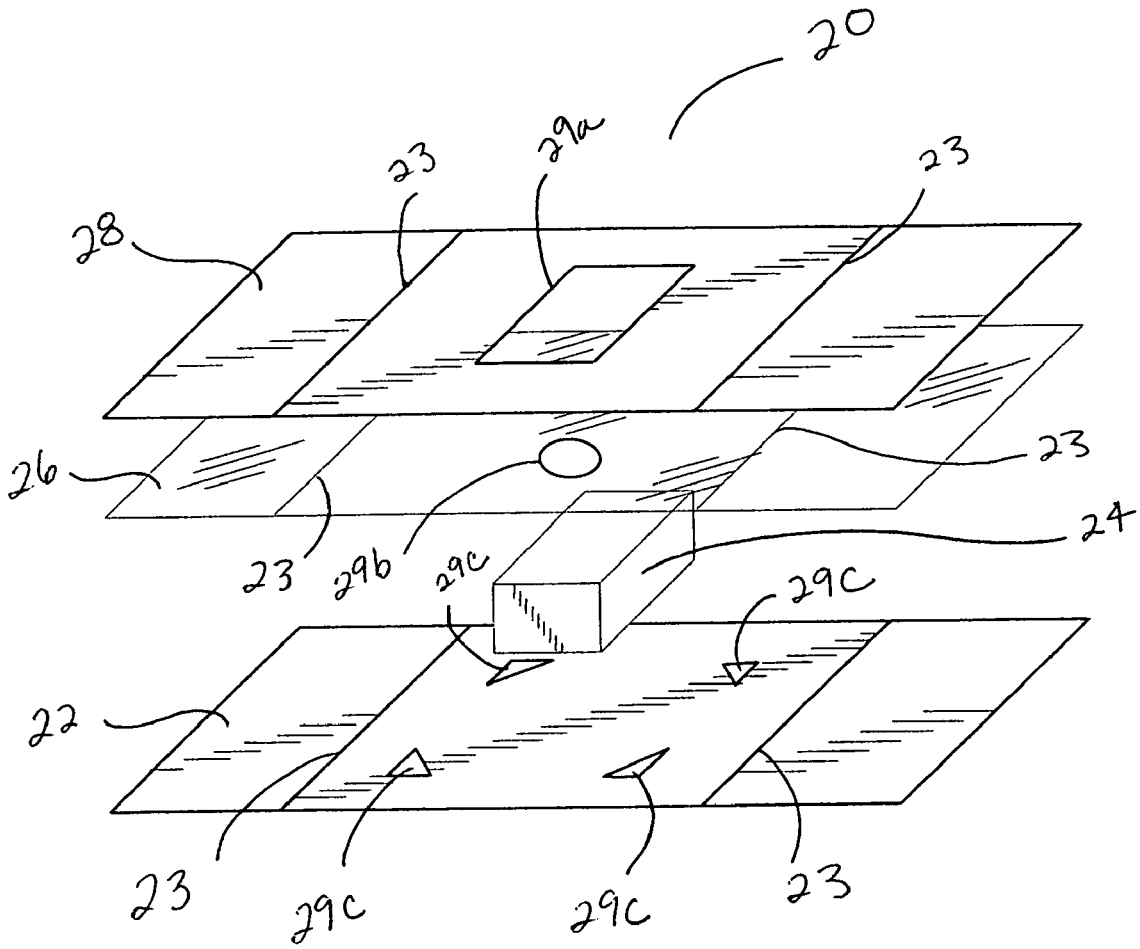
FIG. 2*a* is a perspective view of a packaging assembly in accordance with the present disclosure.

Referring now to FIG. 2*a*, there is shown a perspective view of an exemplary embodiment of an unassembled packaging assembly 20. The packaging assembly 20 may comprise a resilient member 22, a retention member 26 and a framing member 28. The article 24 to be packaged is shown in the relative relationship it may typically be placed, such that as the assembly 20 is assembled by bringing resilient member 22 into contact with framing member 28, article 24 forces retention member 26 to conform to its shape to the shape of the article 24 through opening 29*a* of the framing member 28. It will be appreciated that the resulting structure, as will be fully understood shortly, provides both a very secure packaging system as well as a very aesthetically pleasing presentation of the article to the person receiving the article.

Still referring to FIG. 2*a*, the resilient member 22 may comprise fold lines 23 to direct folding along said line during assembly. The resilient member may be made from any suitable material or combination of materials. For example, the following materials may be selected by those skilled in the art in accordance with the present disclosure: paper, pulp, mesh, weave, metal, polymer, copolymer, laminate, composite or fiber (including materials not already available which, when not already rigid are flexible and/or semi-rigid will bend and which, when are rigid or formed to bend) as well as any polymer, copolymer, laminate, mesh or flexible film, including materials not already available with tear resistance, resilience, memory. The recited examples of materials are not intended to be limiting but rather exemplary of the myriad of possibilities. Very heavy articles to be contained may require a resilient member to be made of suitable materials such as a metal (e.g., structural steel) or a synthetic material (e.g., carbon fiber composite) to provide proper strength, and which may be formed to bend at fold lines 23.

Still referring to FIG. 2*a*, it should also be noted that the resilient member 22 may be made of several layers and/or a plurality of resilient members 22 in order to fine tune its functional properties. For example, the present disclosure makes clear that effective suspension and dampening may be achieved using several layers of varying materials to adjust and tune the characteristics of the resilient member 22 to an optimum value in accordance with the application to which the structure is to be placed.

Continuing to refer to FIG. 2*a*, resilient member 22 may also comprise one or more opening 29*c* therein. The opening 29*c* may be sized such that it corresponds to portions of the article 24. The opening 29*c* may include complex shapes corresponding to the complex shapes any article to be contained. Desirably, the resilient member 22 may have decorative elements provided thereon for improving further the aesthetic impression made during presentation of the article 24 to an recipient of the article. The resilient member 22 may have instructions or article information printed thereon or decorative indicia placed thereon.

Still referring to FIG. 2*a*, the retention member 26 may comprise fold lines 23 to direct folding along said line during assembly. The retention member 26 may be made from any suitable material or combination of materials. For example, the following materials may be selected by those skilled in the art in accordance with the present disclosure: paper, pulp, mesh, weave, metal, polymer, copolymer, laminate, composite or fiber (including materials not already available which, when not already rigid are flexible and/or semi-rigid will bend and which, when are rigid or formed to bend) as well as any polymer, copolymer, laminate, mesh or flexible film, including materials not already available with tear resistance, resilience, memory. The recited examples of materials are not intended to be limiting but rather exemplary of the myriad of possibilities. Very heavy articles to be contained may require a retention member to be made of suitable materials such as a thermoformed polymer to provide proper strength, and which may be formed to bend or scored to fold at fold lines 23.

Still referring to FIG. 2*a*, it should also be noted that the retention member 26 may be made of several layers and/or a plurality of retention members 26 in order to fine tune its functional properties. For example, the present disclosure makes clear that effective tear resistance, elasticity, and/or tensile strength may be achieved using several layers of varying materials to adjust and tune the characteristics of the retention member 26 to an optimum value in accordance with the application to which the structure is to be placed.

Continuing to refer to FIG. 2*a*, retention member 26 may also comprise one or more opening 29*b* therein. The opening 29*b* may be sized such that it corresponds to portions of the article 24. The opening 29*b* may include complex shapes corresponding to the complex shapes any article to be contained. Desirably, the retention member 26 may have decorative elements provided thereon for improving further the aesthetic impression made during presentation of the article 24 to an recipient of the article. The retention member 26 may have instructions or article information printed thereon or decorative indicia placed thereon.

Still referring to FIG. 2*a*, the framing member 28 may comprise fold lines 23 to direct folding along said line during assembly. The framing member 28 may also be made from any suitable material or combination of materials. For example the following materials may be selected by those skilled in the art in accordance with the present disclosure: paper, pulp, metal, polymer, copolymer, laminate, composite or fiber (including materials not already available which, when not already rigid are flexible and/or semi-rigid will bend and which, when are rigid or formed to bend), as well as any polymer, copolymer, laminate, mesh or flexible film (including materials not already available with tear resistance, resilience, memory). The recited examples of materials are not intended to be limiting but rather exemplary of possibilities of materials options.

As indicated above in connection with resilient member 22 and/or retention member 26, heavy objects may suggest a framing member 28 be made of suitable materials such as a metal (e.g., structural steel) or a synthetic material (e.g., carbon fiber composite) to provide proper strength. It should also be noted that the framing member 28 may be made of several layers and/or a plurality of framing members 28 in order to aid in fine tuning the functional properties. For example, materials can be combined as separate components of the framing member 28. The present disclosure makes clear that effective printing and advertising may be achieved using several layers of varying materials to adjust and tune the characteristics of the framing members 28 to an optimum value in accordance with the application to which the structure is to be placed.

Continuing to refer to FIG. 2*a*, framing member 28 may also comprise one or more opening 29*a* therein. The opening 29*a* may be sized such that it corresponds to the article 24. The opening 29*a* may include complex shapes corresponding to the complex shapes any article to be contained, such as the article 24. Desirably, the framing member 28 may have decorative elements provided thereon for improving further the aesthetic impression made during presentation of the article 24 to an recipient of the article. The framing member 28 may have instructions or article information printed thereon or decorative indicia placed thereon.

Figure 2B:
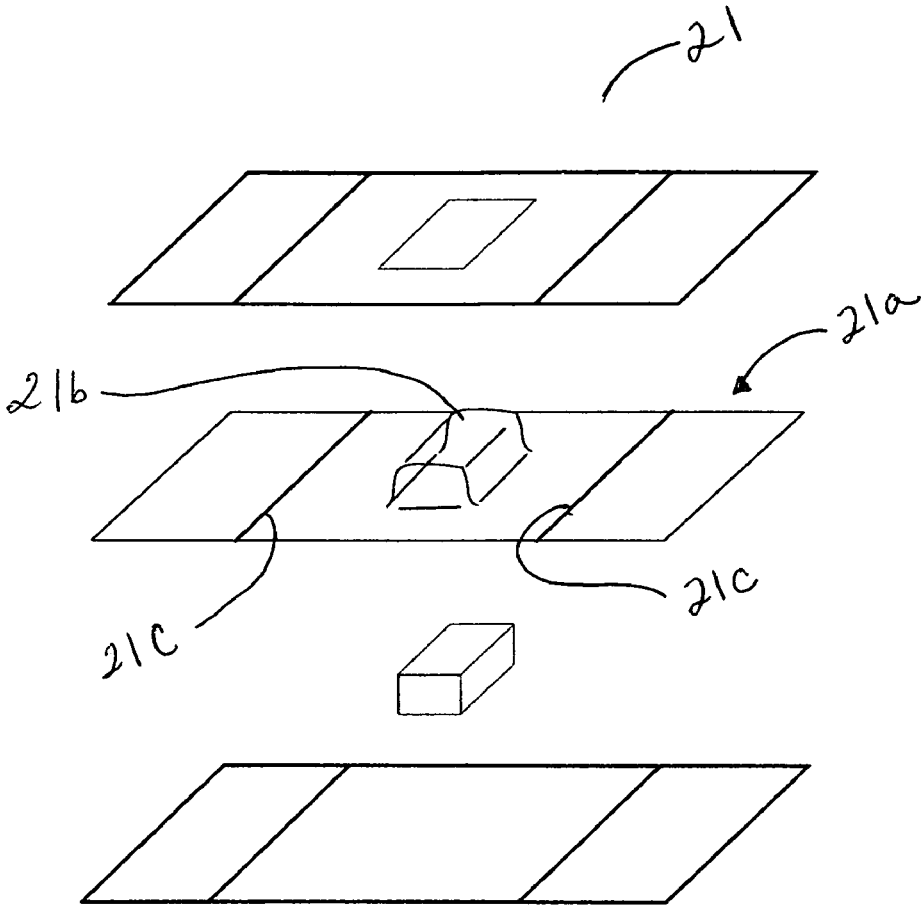
FIG. 2*b* is a perspective view of a packaging assembly in accordance with the present disclosure.

Referring now to FIG. 2*b*, there is shown a perspective view of an exemplary embodiment of an unassembled packaging assembly 21. As indicated above in connection with FIG. 2*a* the packaging assembly 21 may comprise a retention member 21*a*. The Retention member may comprise a portion 21*b* formed. The retention member 21 may comprise fold lines 21*c* to direct folding along said line during assembly.

Figure 2C:
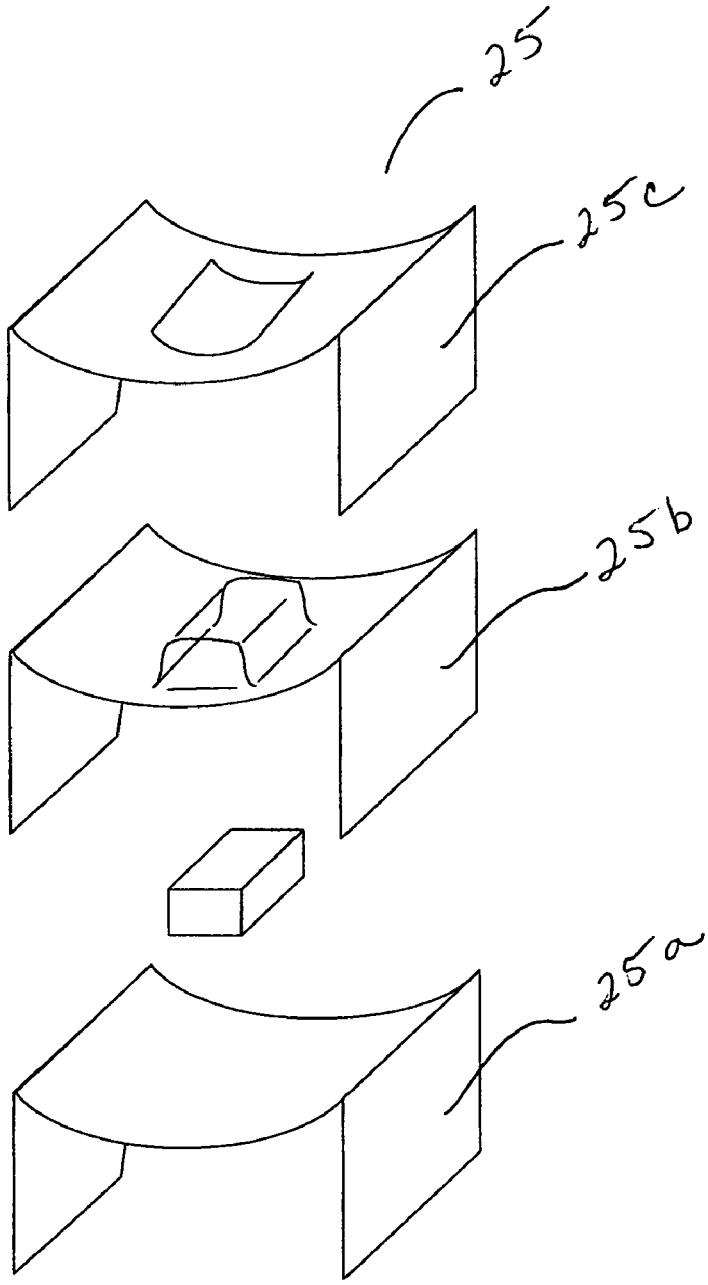
FIG. 2*c* is a perspective view of a packaging assembly in accordance with the present disclosure.

Referring now to FIG. 2*c*, there is shown a perspective view of an exemplary embodiment of an unassembled packaging assembly 25. As indicated above in connection with FIG. 1 the packaging assembly 25 may comprise a formed arched member 25*a*, a formed retention member 25*b*, and a formed frame member 25*c*.

Figure 3:
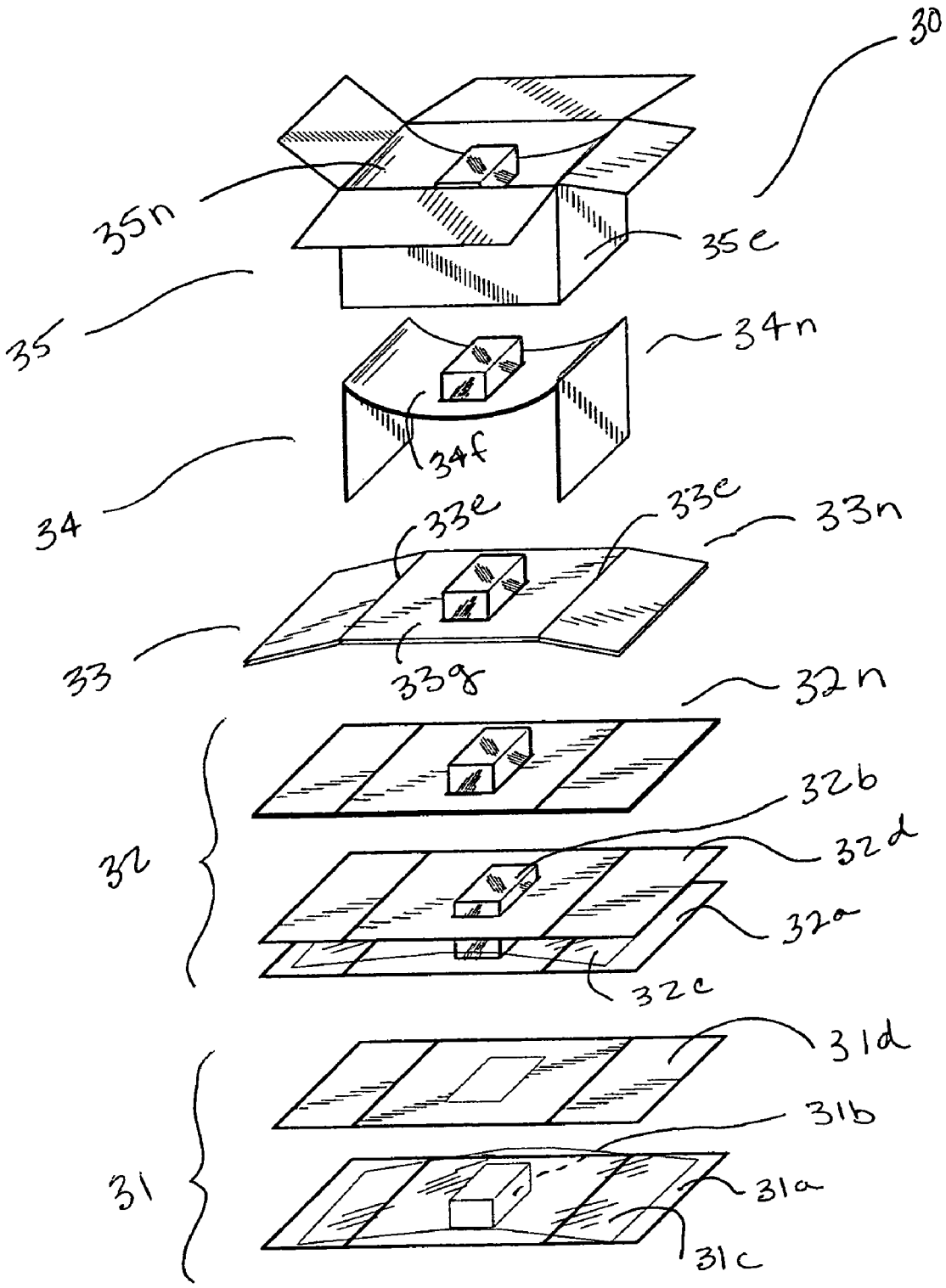
FIG. 3 is an embodiment illustrating a method for assembling a package assembly in accordance with the present Disclosure.

Referring now to FIG. 3, there is represented an illustrative method of assembling a package assembly 30. The process represented by the structures indicated at 31 illustrates the components of a packaging assembly having resilient member 31*a*, article 31*b*, retention member 31*c* and framing member 31*d* being readied for use. The process represented at 31 comprises placing an article 31*b* onto the resilient member 31*a*. Next, the retention member 31*c* is laid over the article 31*a* and the framing member 31*d* is then positioned over the retention member 31*c* such that an opening in the framing member 31*d* is positioned over the article 31*b*.

The process represented by the structures indicated at 32 is illustrative of a process of compressing the components together. The process comprises with the opening in framing member 32*d* directly over article 32*b*, the framing member 32*d* is pressed toward the resilient member 32*a* until the members are substantially touching over a substantial part of there opposing faces. By pressing the members together article 32*b* protrudes though the opening in framing member 32*d*, thereby causing the deformation of the retention member 32*c*. The deformation of the retention member 32*c* is constrained by both to shape of the article 32*b* and the opening in 32*d*, thereby creating a pocket around the article 32*b*, holding it in place for suspension and display. When the components are pressed in place the result is a packaging assembly 32*n*. In the numbering in the figure, "n" is used to represent the combination of "a, b, c, and d."

In a process for forming the structure illustrated at 33 the packaging assembly 32*n* is folded along fold lines 33*e* creating vertical portions in the packaging assembly 33*n* disposed on either end of the center portion 33*g*. The folds may be folded to 90 degrees, and it is also consistent with the disclosure to have angles greater or less than 90 degrees.

In a process for forming the structure illustrated at 34 an arching portion 34*f* is formed in packaging assembly 34*n*. The arch may be held in a arched state by the corresponding sides of the container. The arch may be formed so as to remain in an arched form without external force. The arch may be pretensioned for optimally suspending in a predetermined manner to respond to anticipated loading.

In a process for forming the structure illustrated at 35 the packaging assembly 35*n* is placed into a container 35*e* forming package assembly 30. The container 35*e* may provide compressive force as an aid in holding the packaging assembly in and arched configuration. Other methods that interchange or slightly modify one or more processes are within the scope of this application.

Figure 4:
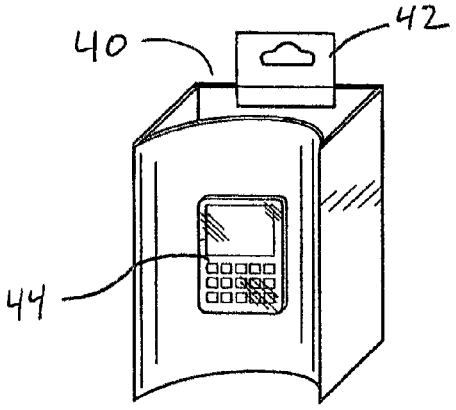
FIG. 4 is a perspective view of a primary packaging assembly in accordance with the present Disclosure.

Referring now to FIG. 4 an illustrative embodiment of a packaging assembly 40 in accordance with the present disclosure is represented. The packaging assembly 40 may provide features to aid in display and presentation of article 44 such as a hang tab 42 for hanging in commonly used display structures. The packaging assembly 40 may desirably be the primary packaging of an article 44. The primary packaging of an article would be a packaging assembly 40 that holds the article 44 for display absent or naked of any other packaging. For example, the packaging assembly 40 may be fabricated from clear materials such that the article 44 can be readily viewed within the package.

Figure 5:
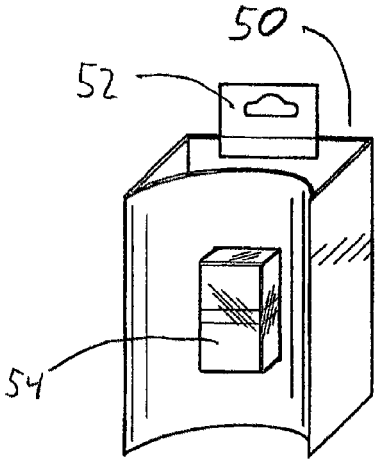
FIG. 5 is perspective view of a secondary packaging assembly in accordance with the present Disclosure.

Referring now to FIG. 5, an illustrative embodiment of a packaging assembly 50 is represented. The packaging assembly 50 may provide features to aid in display such as a hang tab 52 for hanging in commonly used displays. A packaging assembly 50 may be the secondary packaging of an article 54.

A secondarily packaged article would come in its own proprietary and/or primary packaging and would then be secondarily packaged within a packaging assembly 50.

Figure 6:
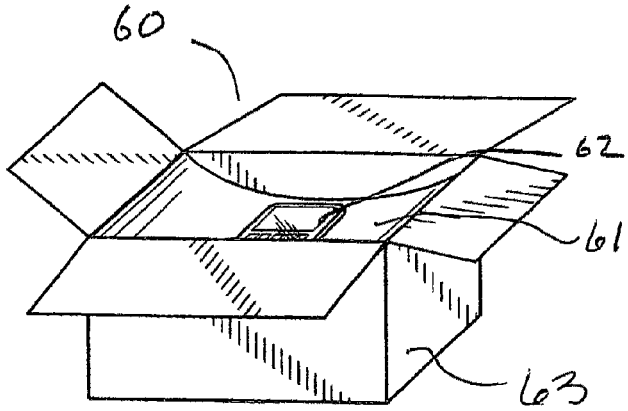
FIG. 6 is perspective view of a primary and tertiary package assembly in accordance with the present Disclosure.

Referring now to FIG. 6, an illustrative embodiment of a package assembly 60 in accordance with the present disclosure is represented. The package assembly 60 may provide features to aid in display and presentation and warehousing and shipping of an article 62 with a primary and secondary packaging assembly 61 within a tertiary container 63. The package assembly 60 as seen in FIG. 6 would desirably provide a centered and upright article upon opening the package. Aside from aiding in the presentation aspect of the article 62 the package assembly 60 would suspend the article 62 in the container 63 for protection. It will be appreciated that the package assembly 60 can be structured in accordance with those structures represented in FIGS. 1-3.

Figure 7:
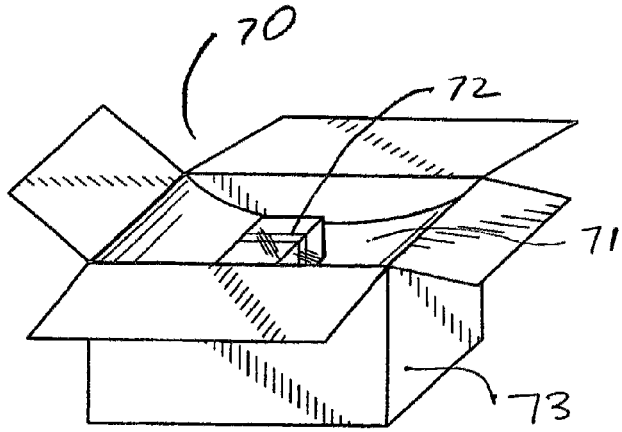
FIG. 7 is a perspective view of a secondary and tertiary package assembly in accordance with the present Disclosure.

Referring now to FIG. 7, an illustrative embodiment of a package assembly 70 is represented. The package assembly 70 may provide features to aid in display and presentation, warehousing and shipping of an article 72 with a secondary packaging assembly 71 within a tertiary container 73. A package assembly 70, as seen in FIG. 7, would provide a centered and upright primary packaged article upon opening the package assembly 70. In addition to aiding in the presentation of the article 72, the package assembly 70 would suspend the article 72 in the container 73 for protection. It will be appreciated that the package assembly 70 can be structured in accordance with those structures represented in FIGS. 1-3.

Figure 8:
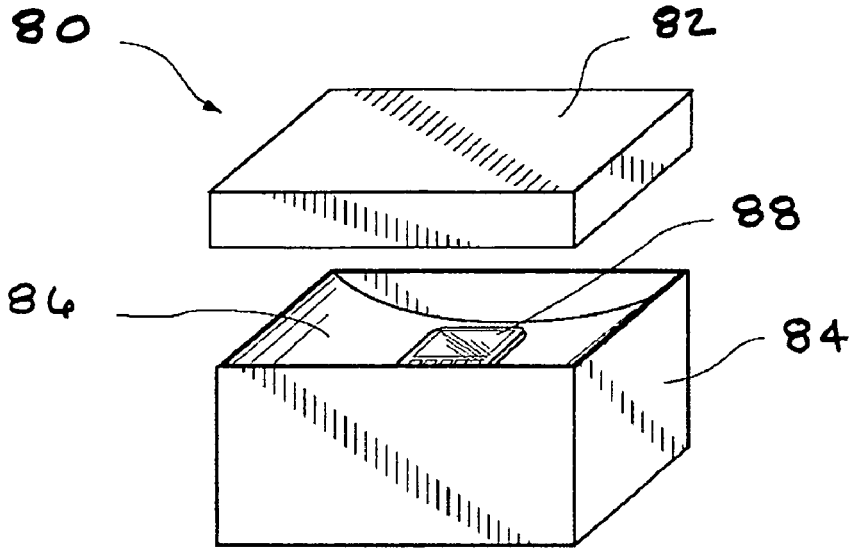
FIG. 8 is a perspective view of a primary and tertiary gift package assembly in accordance with the present Disclosure.

Referring now to FIG. 8, an illustrative embodiment of a package assembly 80 is represented. The package assembly 80 may particularly be used in a gift box arrangement having a lid 82, container 84 and a packaging assembly 86. Package assembly 86 may provide features to aid in display and presentation of an article 88 as primary packaging within a gift box. The packaging assembly 86 as seen in FIG. 8 provides a centered and upright article 88 upon opening of the gift box. In addition to aiding in the presentation aspect of the article 88 the packaging assembly would suspend the packaged article within the container 84 for protection. It will be appreciated that the packaging assembly 86 can be structured in accordance with those structures represented in FIGS. 1-3 and that decorative and informative indicia can be added to the structures appropriate to the gift occasion.

Figure 9:
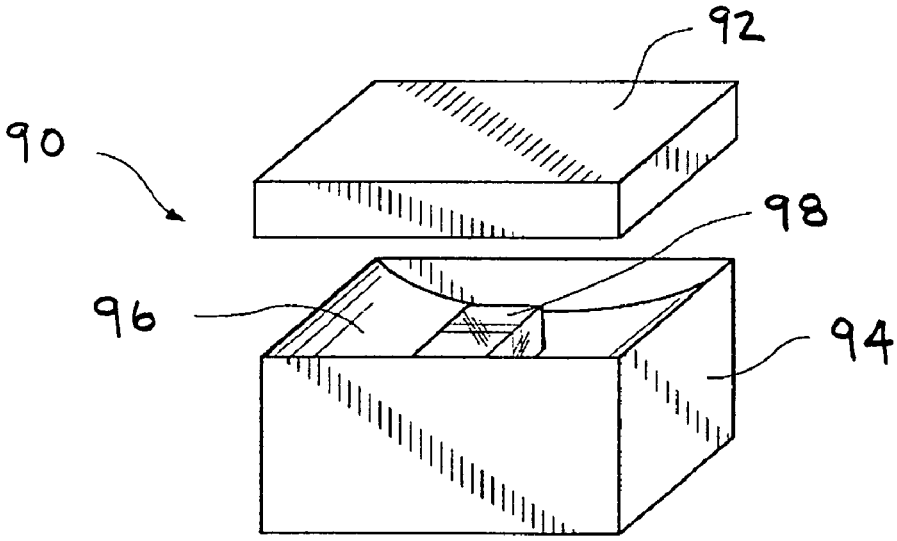
FIG. 9 is perspective view of a secondary and tertiary package assembly in accordance with the present Disclosure.

Referring now to FIG. 9, an illustrative embodiment of a package assembly 90 is represented. A package assembly 90 may be used in a gift box arrangement having a lid 92, container 94 and a packaging assembly 96. Packaging assembly 96 may provide features to aid in display and presentation of an article 98 as secondary packaging within a gift box. A packaging assembly 96 as seen in FIG. 9 provides a centered and upright packaged article upon opening the gift box. In addition to aiding in the presentation aspect of the article 98 the packaging assembly 96 would suspend the packaged article within the container 94 for protection. It will be appreciated that the packaging assembly 96 can be structured in accordance with those structures represented in FIGS. 1-3 and that decorative and informative indicia can be added to the structures appropriate to the gift occasion.

Figure 10:
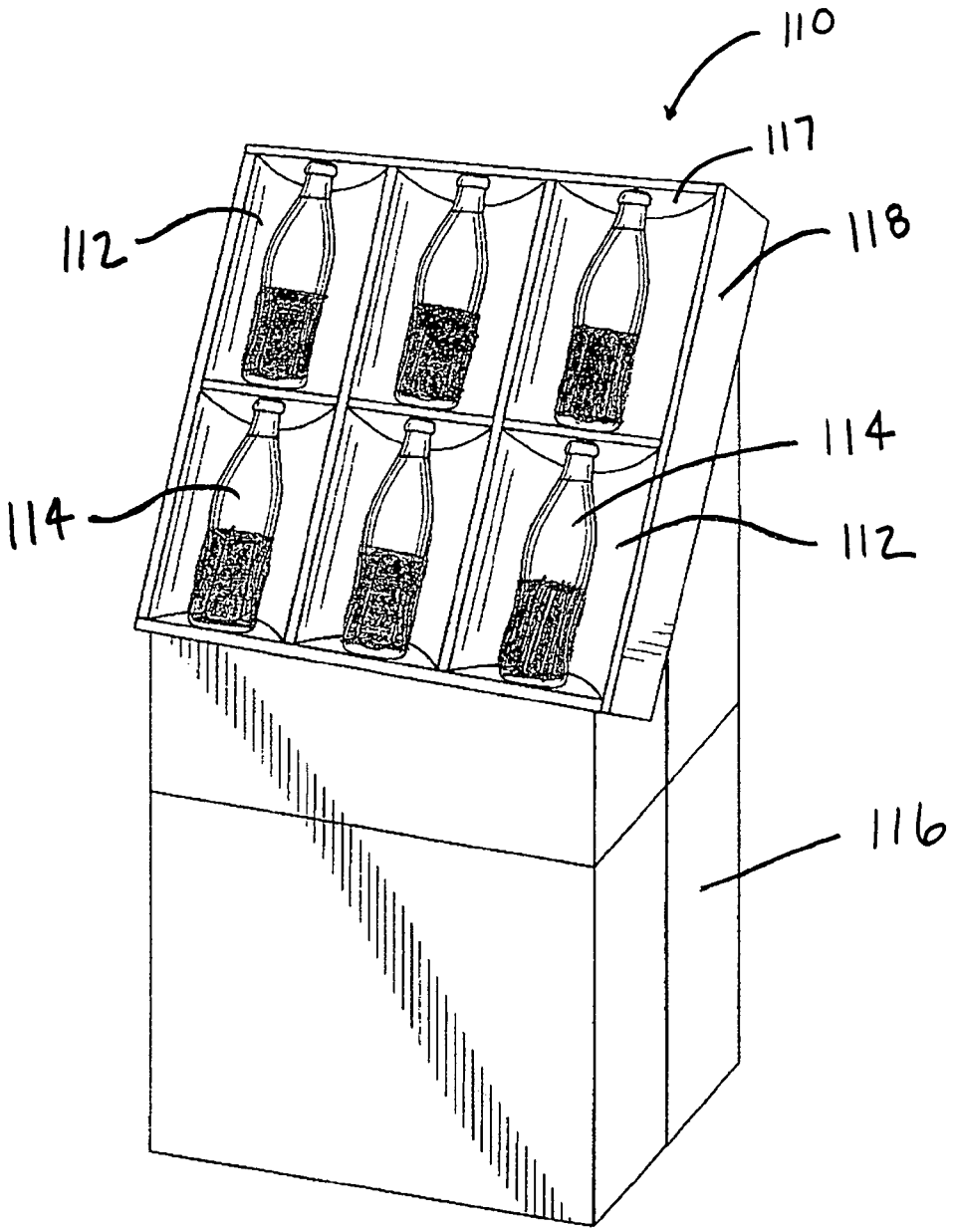
FIG. 10 is a perspective view of a display package assembly in accordance with the present Disclosure.

Referring now to FIG. 10, an illustrative embodiment of a package assembly 110 in accordance with the present disclosure. The package assembly 110 may be used in a retail or trade show display arrangement having, a lid 118, container 117, display 116, and a plurality of packaging assembly 112. Packaging assembly 112 may provide feature to aid in display and presentation of article 114 as a primary packaging within a display 116. In a retail environment, the packaging assembly 112 may be used to attractively display articles 114. The package assembly 116 may contain structures and features that enable them to be stacked or combined in a way that promotes retail floor display. For example, package assembly 110 may include a feature of having a removable display 116 for displaying the contents thereof, or a removable lid 118 to aid in displaying or in shipping.

Figure 11:
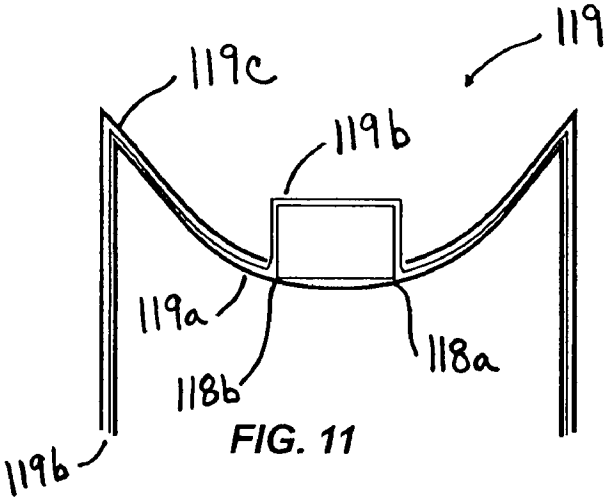
FIG. 11 is a cross-sectional view a packaging assembly in accordance with the present Disclosure.

Referring now to FIG. 11, a cross-sectional side view of an illustrative embodiment of a packaging assembly 119 in accordance with the present application is represented. The packaging assembly 119 has an arched member 119*a*, which supports the article 118. Where the arched member 119*a* makes contact with the article 118, there are contact points 118*a*, 118*b*. The arched member 119*a* dampens and absorbs forces over the length of the arch, thereby protecting the article 118. The retention member 119*b* holds the article 118 in place by forming around the article 118 as a result of the arched member 119*a* and framing member 119*c* coming together.

Figure 12:
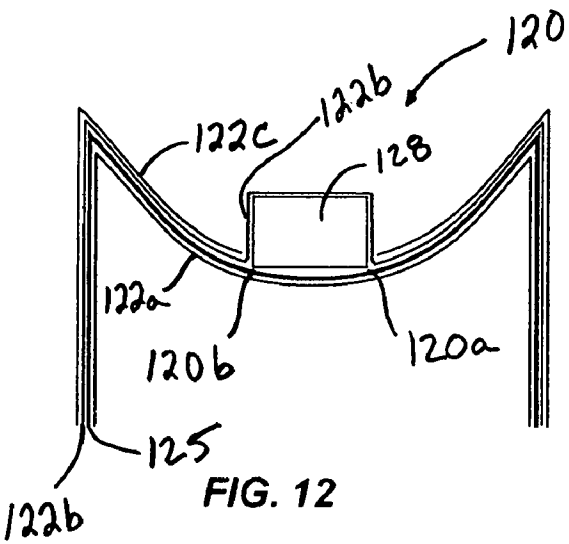
FIG. 12 is a cross-sectional view a packaging assembly with an additional absorption member in accordance with the present Disclosure.

Referring now to FIG. 12, a cross-sectional side view of another illustrative embodiment of a packaging assembly 120 in accordance with the present application is represented. The packaging assembly 120 has an arched member 122*a*, which supports the article 128. The arched member 122*a* dampens and absorbs forces over the length of the arch, thereby protecting the article 128. Further dampening and protection may be achieved with the addition of an adsorption member 125. The absorption member 125 makes contact with the article 128 at the contact points 120*a*, 120*b*, adding more protection to article 128 in addition to the support and protection provided by arched member 122*a*. Those skilled in the art will be able to select a single layer of material, or multiple layers of the same or differing materials, from which to fabricate the absorption member 125 in accordance with the present disclosure. The retention member 122*b* holds the article 128 in place by forming around the article 128 as a result of the arched member 122*a* and framing member 122*c* coming together.

Figure 13B:
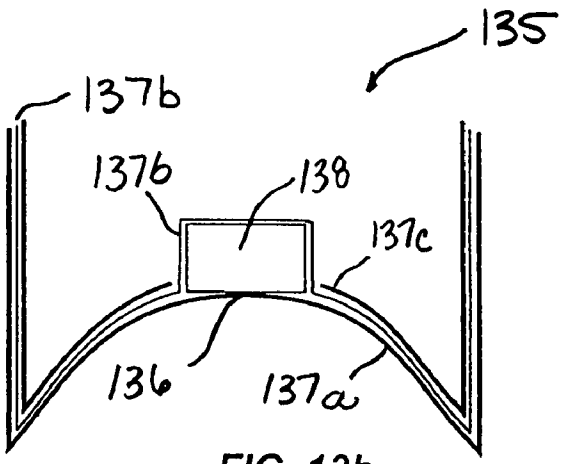
FIG. 13*b* is a cross-sectional view a packaging assembly inverted in accordance with the present Disclosure.
Figure 13A:
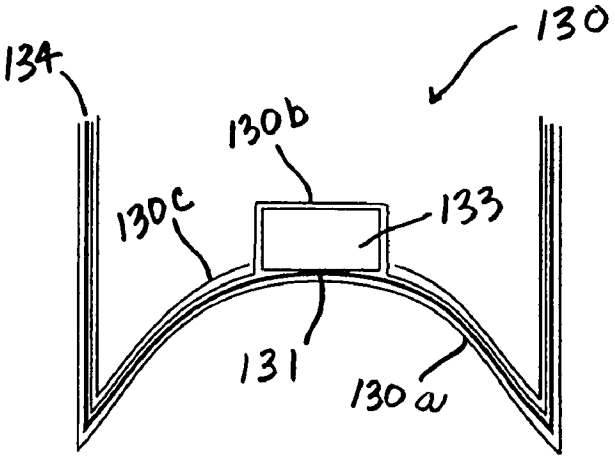
FIG. 13*a* is a cross-sectional view a packaging assembly inverted with an additional absorption member in accordance with the present Disclosure.

Referring now to FIG. 13*a*, a cross-sectional side view of an illustrative embodiment of a packaging assembly 130 in accordance with the present application is represented. The packaging assembly 130 has an arched member 130*a*, which supports the article 133. The arched member 130*a* dampens and absorbs forces over the length of the arch, thereby protecting the article 133. Further dampening of forces may be achieved with the addition of an absorption member 134. The absorption member 134 makes contact with the article 133 at the contact point 131, adding more protection to article 133 in addition to the support and protection provided by arched member 130*a*. As described above in connection with absorption member 125, those skilled in the art will be able to select a single layer of material, or multiple layers of the same or differing materials, from which to fabricate the absorption member 134 in accordance with the present disclosure. The retention member 130*b* holds the article 133 in place by forming around the article 133 as a result of the arched member 130*a* and framing member 130*c* coming together.

Referring now to FIG. 13*b*, a cross-sectional side view of an illustrative embodiment of a packaging assembly 135 in accordance with the present application is represented. The packaging assembly 135 has an arched member 137*a* that is in contact with the article 138. Where the arched member 137*a* makes contact with the article 138 there is a contact point 136. The arched member 137*a* supports the article 138 and dampens and absorbs forces over the length of the arch, thereby protecting the article 138. The retention member 137*b* holds the article 138 in place by forming around the article 138 as a result of the arched member 137*a* and framing member 137*c* coming together.

Figure 14:
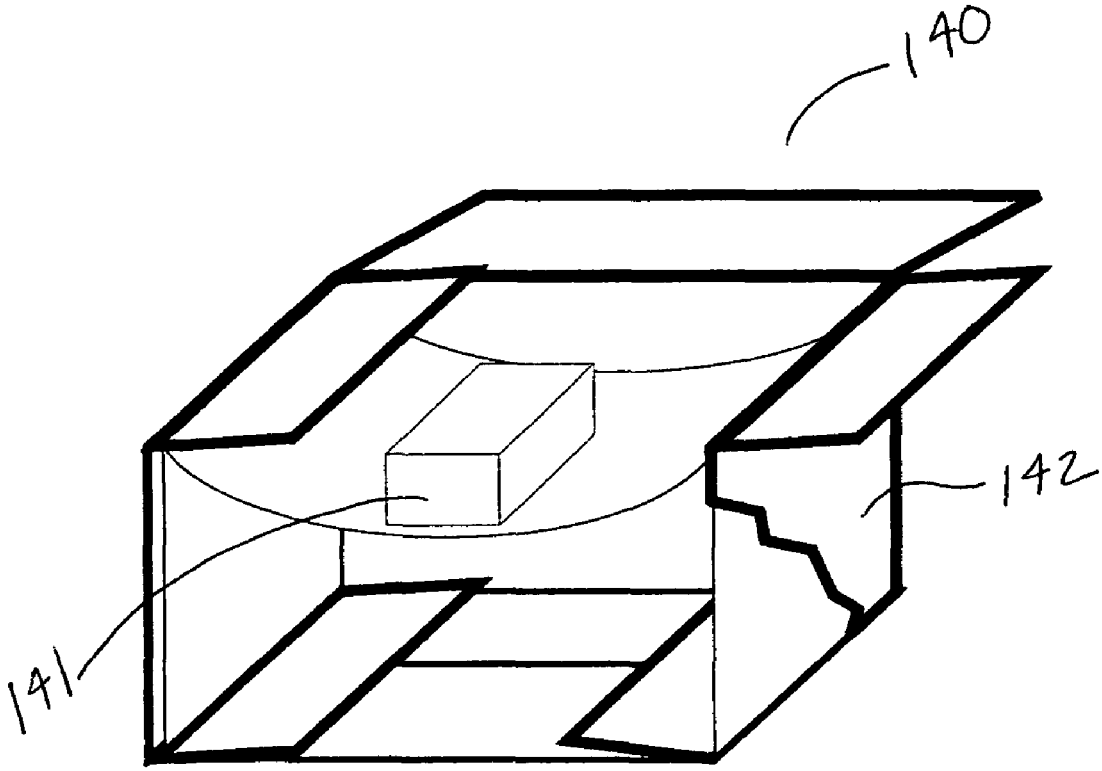
FIG. 14 is cutaway perspective view of a package assembly in accordance with the present Disclosure.

Referring now to FIG. 14, a cutaway view of an illustrative embodiment of a package assembly 140 in accordance with the present disclosure is represented. The package assembly 140 suspends the article 141 in the interior of the container 142 away from the walls of the container 142 which are susceptible to impact.

Figure 15:
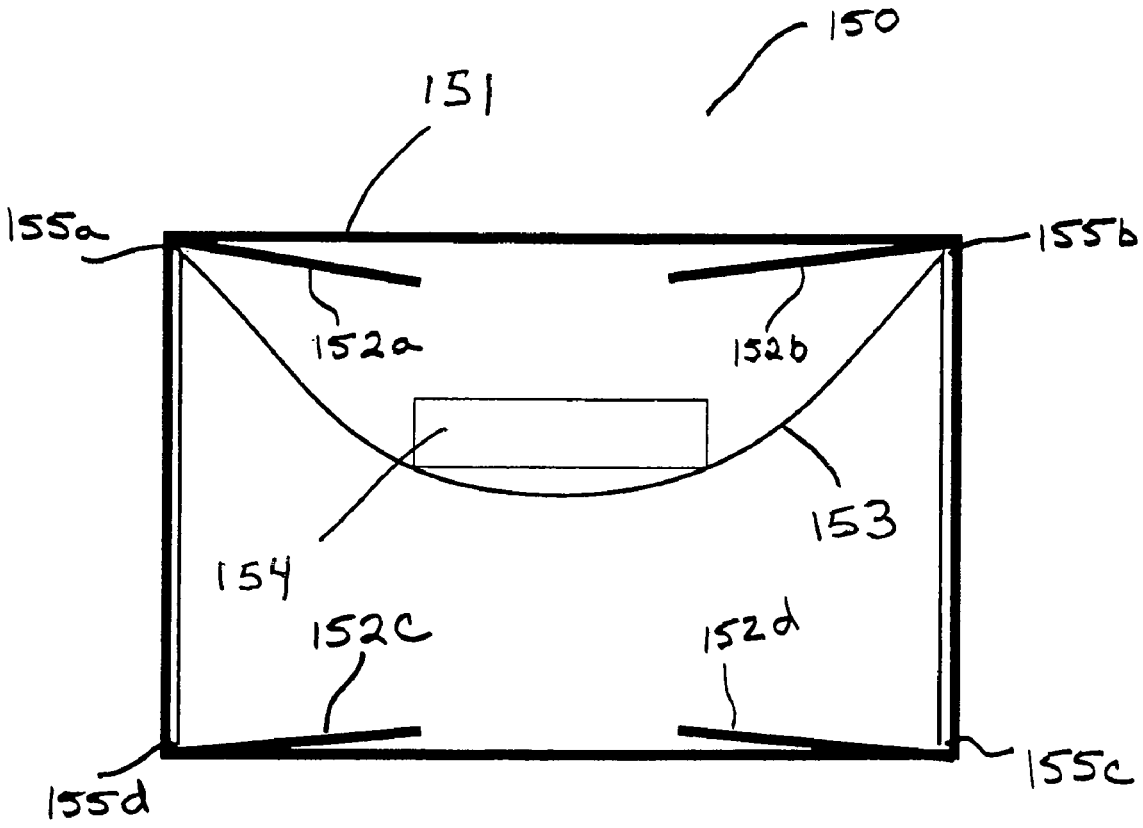
FIG. 15 is a cross-sectional view of a package assembly in accordance with the present Disclosure.

Referring now to FIG. 15, a cross-sectional side view of an illustrative embodiment of a package assembly 150 in accordance with the present disclosure is represented. The package assembly 150 may comprise a container 151 having flaps 152*a*, 152*b*, 152*c*, and 152*d*, and a packaging assembly 153 disposed within the container 151. The packaging assembly may contact the container at contact points 155*a*, 155*b*, 155*c*, and 155*d*. When it is desirable to reduce the degrees of freedom within any system to make the system more predictable and therefore more effective for a targeted task, container 151 may provide locking and affixing means. Flaps 152*a*, 152*b*, 152*c*, and 152*d* provide a locking or affixing means at points 155*a*, 155*b*, 155*c*, and 155*d*, by impeding movement of packaging assembly 153 while inside container 151 and thereby providing more effective suspension for article 154. The packaging assembly may contact the container at contact points 155*a*, 155*b*, 155*c*, and 155*d*. By dimensioning the packaging assembly at certain points there is a reduction in the degrees of freedom for all remaining points within the packaging assembly. By reducing the degrees of freedom within any system makes the system more predictable and therefore more effective for a targeted task. Flaps 152*a*, 152*b*, 152*c*, and 152*d* provide a locking or affixing means at points 155*a*, 155*b*, 155*c*, and 155*d*, by impeding the kinematic path of the points 155*a*, 155*b*, 155*c*, and 155*d* and thereby providing more effective suspension for a given article 154.

Figure 16:
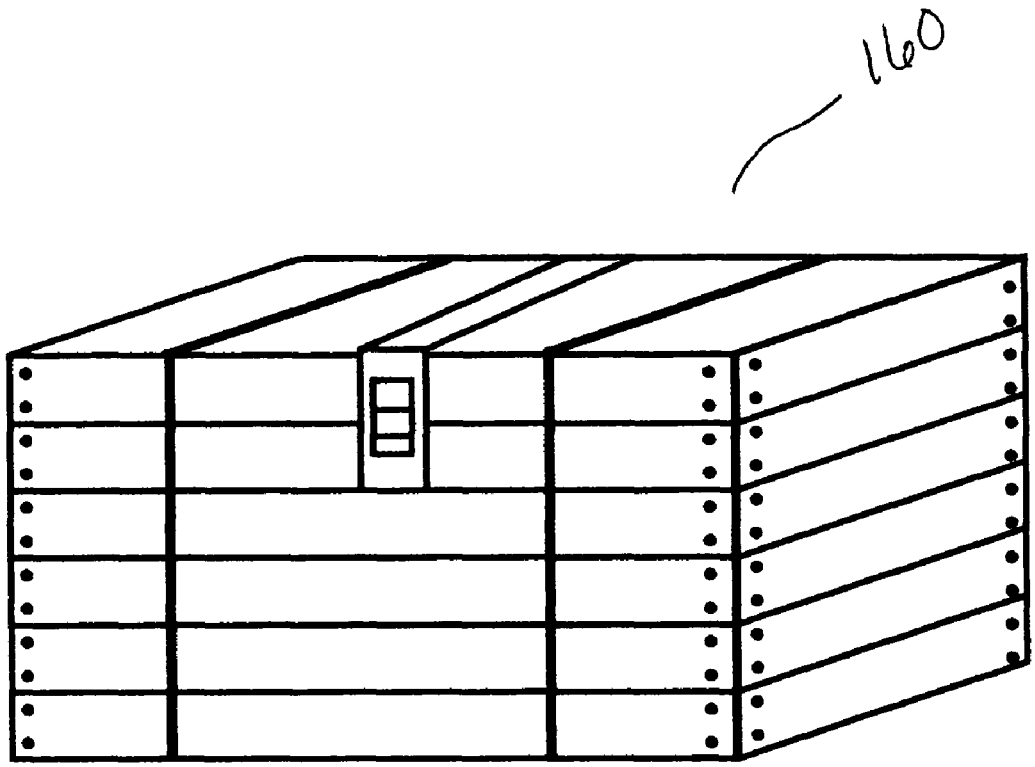
FIG. 16 is perspective view of a package assembly particularly adapted for large and/or heavy articles in accordance with the present Disclosure.

Referring now to FIG. 16, there is shown an illustrative embodiment of a heavy duty package assembly 160. The perspective view illustrates a structure capable of accepting hardware and mechanical and chemical fastening mechanisms and is particularly adapted for storing and shipping large and/or heavy articles.

Figure 17:
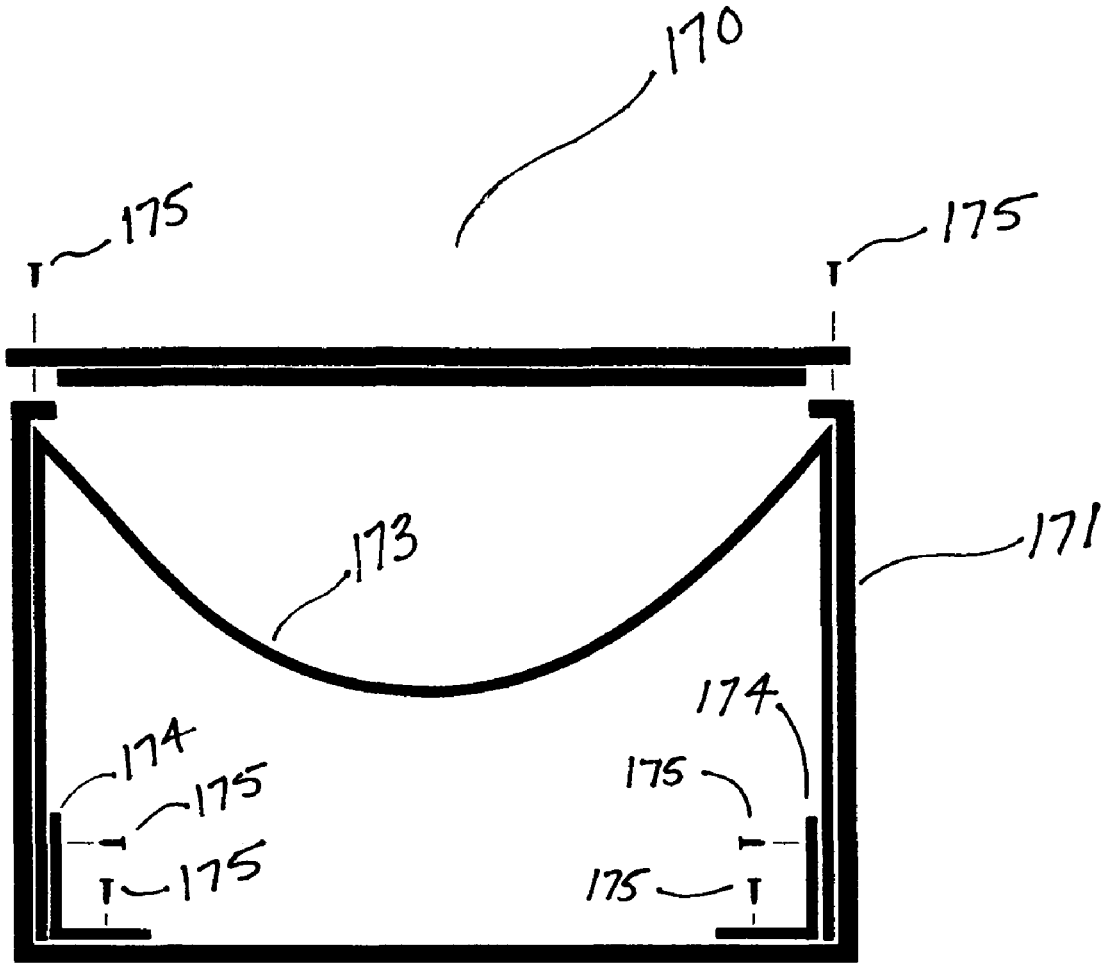
FIG. 17 is cross-sectional view of a package assembly particularly adapted for large and/or heavy articles in accordance with the present Disclosure.

Referring now to FIG. 17, a cross-sectional side view of an illustrative embodiment of a package assembly 170 in accordance with the present disclosure is represented. The package assembly 170 may comprise a container 171 having a packaging assembly 173 disposed within the container 171. By affixing the packaging assembly 173 to the container 171 there is a reduction in the degrees of freedom within the packaging assembly. Mechanical fixtures 174 and fasteners 175 may provide a locking or an affixing means of reduction in the degrees of freedom and thereby providing more effective suspension in a targeted application. By reducing the degrees of freedom within any system makes the system more predictable and therefore more effective for a targeted task. The container 171 can be fabricated from any suitable material with sturdy materials such as metal, wood, plastics and composites being usable.

Figure 18:
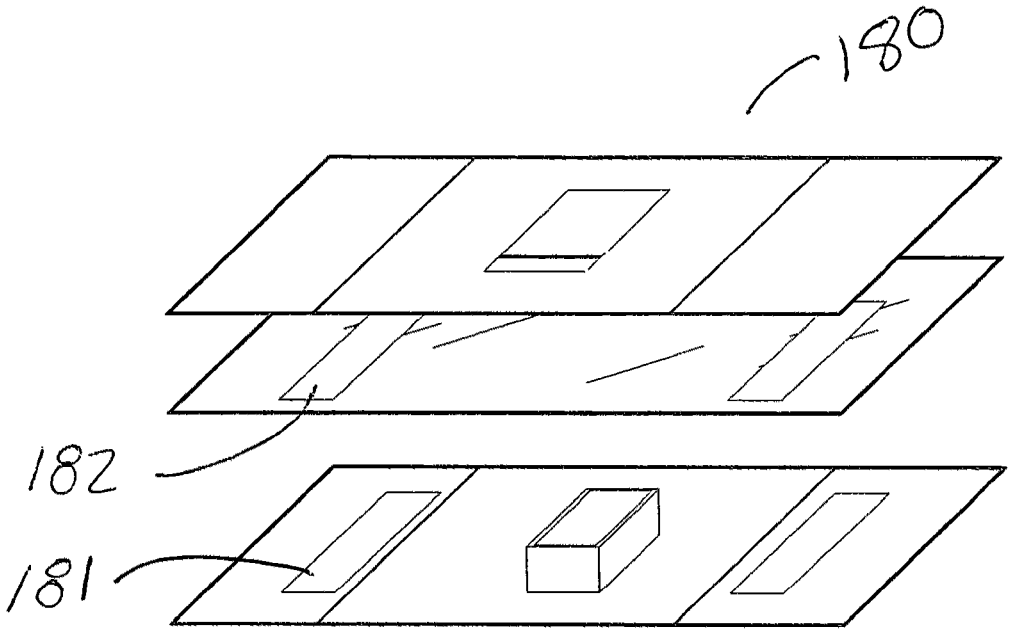
FIG. 18 is a perspective view of a packaging assembly in accordance with the present Disclosure.

Referring now to FIG. 18, there is shown an illustrative embodiment of the separated components of a packaging assembly 180 with adhesives 181 & 182 applied to various surfaces of the members. The adhesives 181 & 182 may provide additional means of fine tuning the suspension of the packaging assembly by locking predetermined members together thereby forcing the members to act together for a composite effect. The adhesives 181 & 182 can be any number of materials having adhesive properties, which can be selected and applied by those skilled in the art using the present disclosure.

Figure 19:
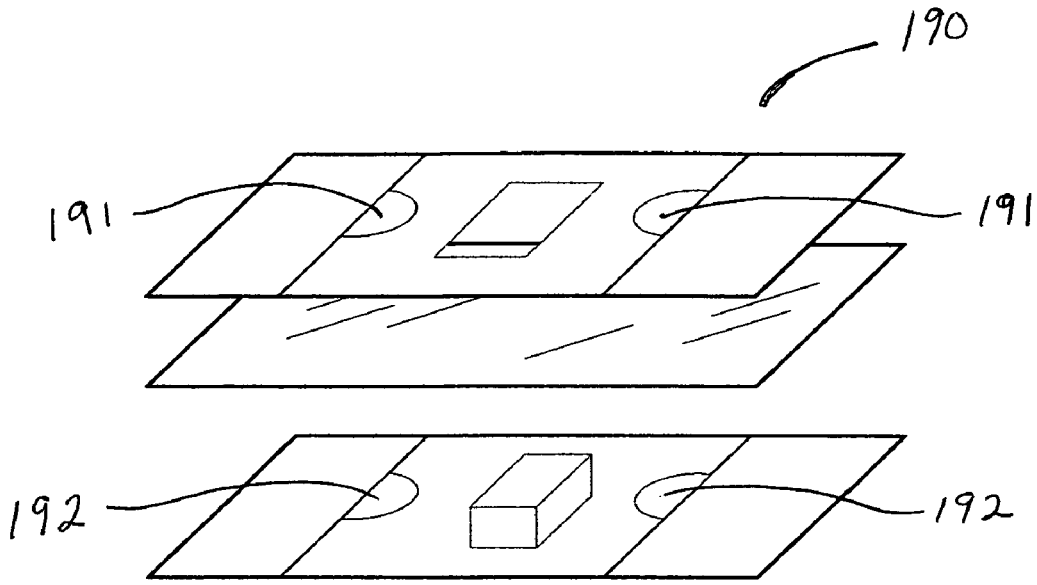
FIG. 19 is a perspective view of a packaging assembly having cutouts in accordance with the present Disclosure.
Figure 20:
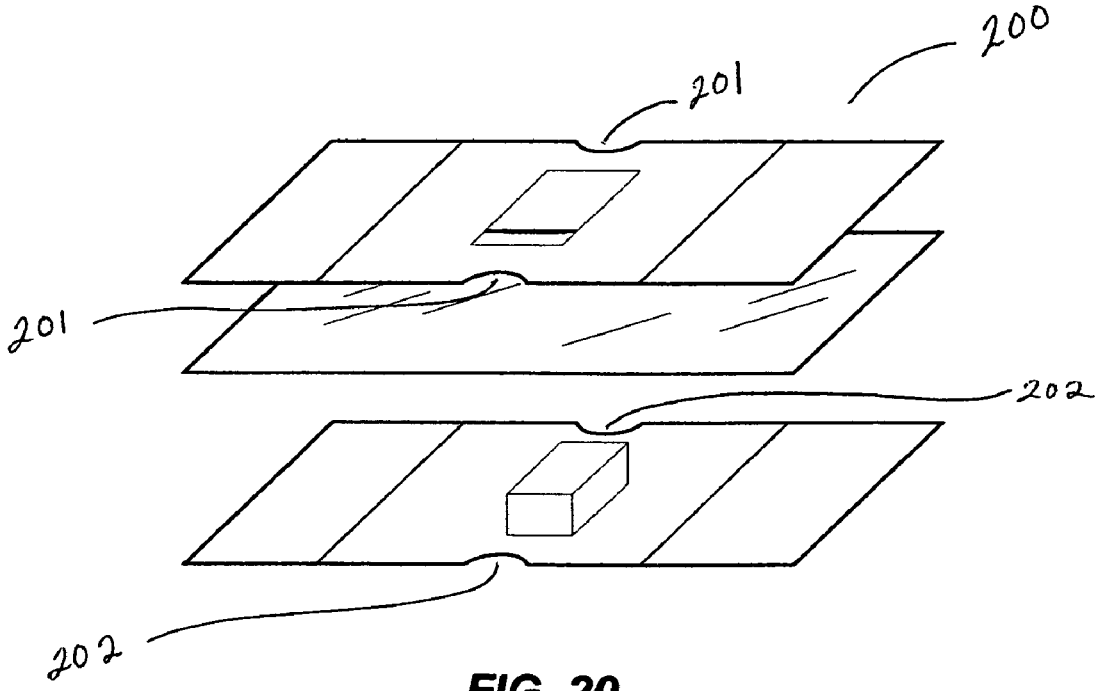
FIG. 20 is a perspective view of a packaging assembly having cutouts in accordance with the present Disclosure.

Referring now to FIGS. 19 and 20, there are shown illustrative embodiment of unassembled packaging assemblies 190 and 200 having cutouts 191, 192, 201 & 202. The cutouts 191, 192, 201 & 202 may aid in accessing the article, by providing finger holds by which to remove the members and thus the article, from a container. Cutouts may also be used to further secure an article in the packaging assembly and may be placed on each or any assembly member where those skilled in the art will be able to determine in accordance with the present disclosure. Additional means of accessing the articles may be tabs or loops provided on the members, and are contemplated within the scope of the present disclosure.

Figure 21:
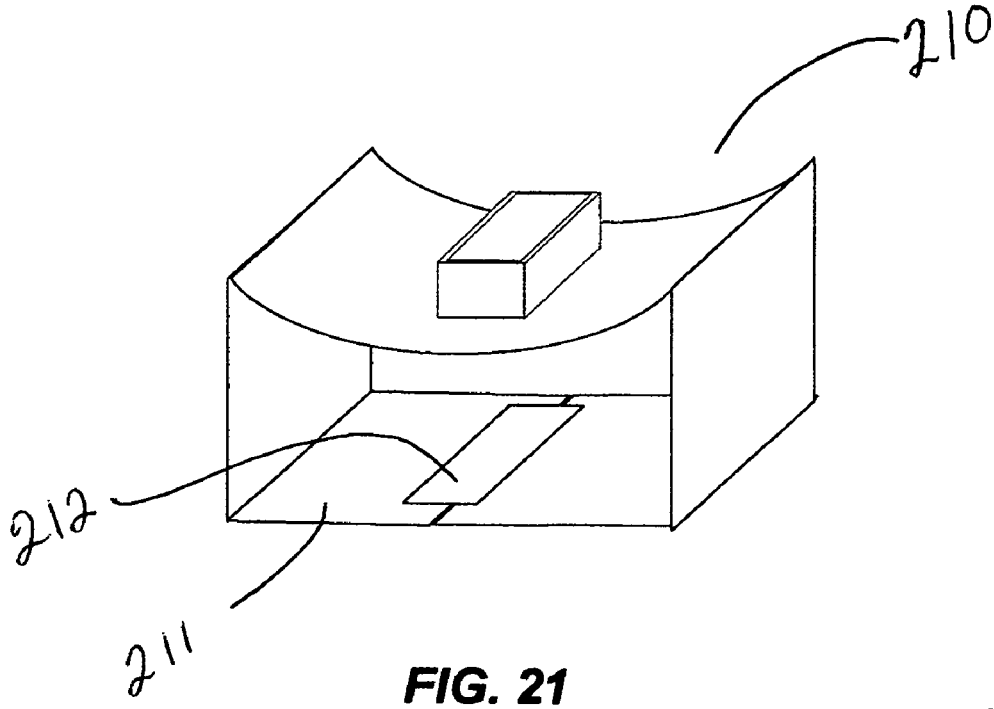
FIG. 21 is a perspective view of an alternative exemplary embodiment of a packaging assembly having adhesive features in accordance with the present Disclosure.

Referring now to FIG. 21, there is shown an illustrative embodiment of a packaging assembly 210 having extended portions 211. In the embodiment of FIG. 21, adhesive 212 may be provided for locking together the extended portions 211 providing desirable packaging properties.

Figure 22:
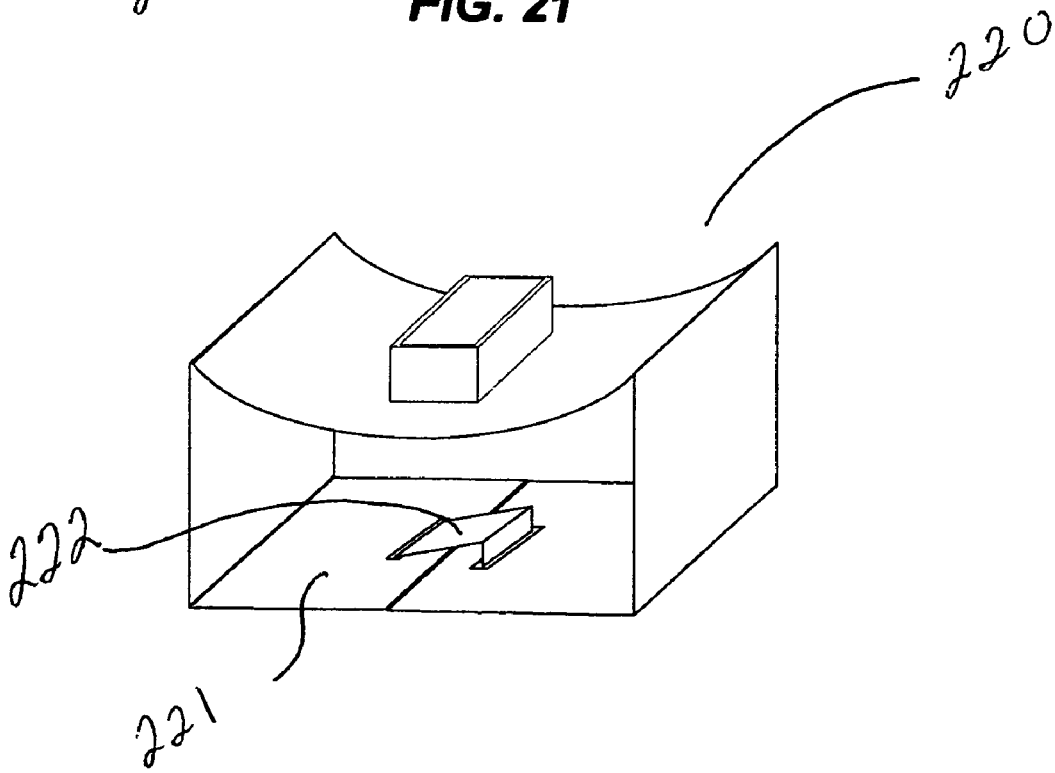
FIG. 22 is a perspective view of an alternative exemplary embodiment of a packaging assembly having locking features in accordance with the present Disclosure.

Referring now to FIG. 22, there is shown an illustrative embodiment of a packaging assembly 220 having extended portions 221. In the embodiment of FIG. 22 a latch 222 may be provided for locking together the extended portions 221 providing desirable packaging properties.

Figure 23:
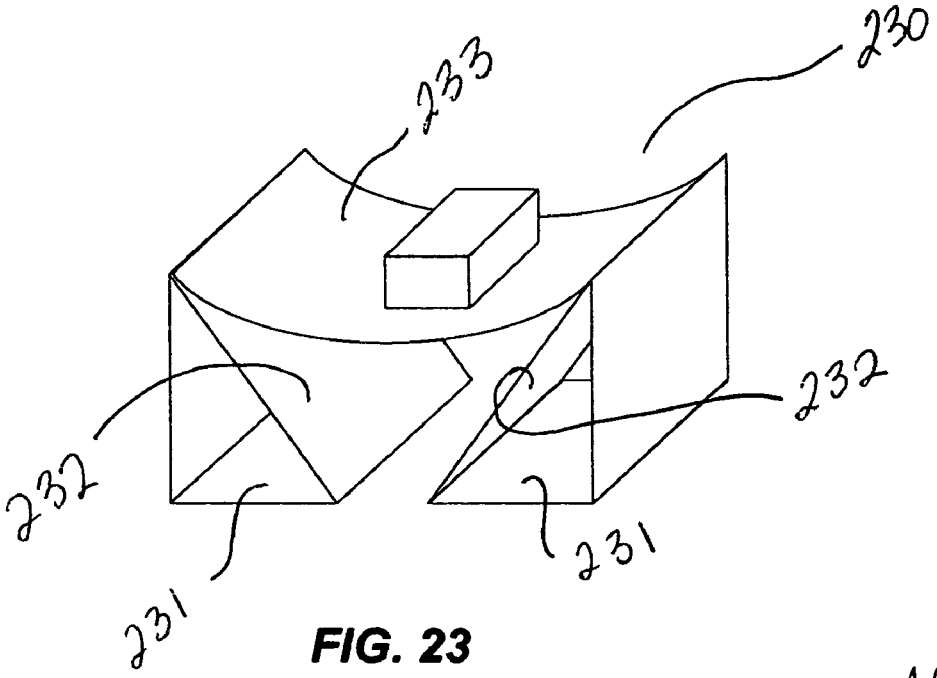
FIG. 23 is a perspective view of an alternative exemplary embodiment of a packaging assembly with extended portions in accordance with the present Disclosure.

Referring now to FIG. 23, there is shown an illustrative embodiment of a packaging assembly 230 having extended portions 231. In the embodiment of FIG. 23 extended angled portions 232 connect extended portion 231 to a corresponding end of an arched member 233 providing desirable packaging properties.

Figure 24:
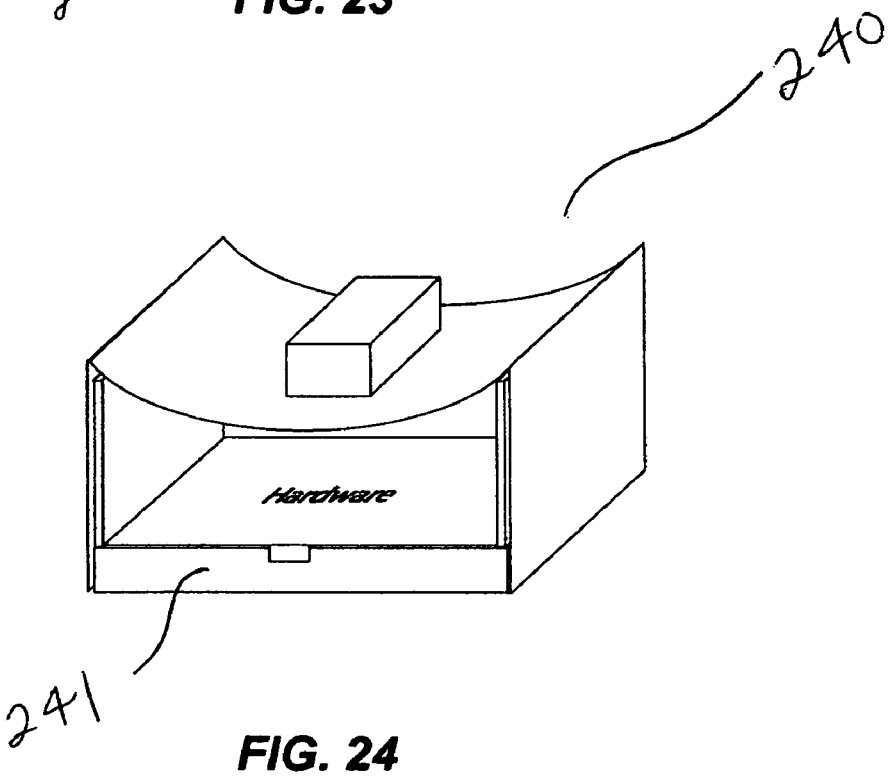
FIG. 24 is a perspective view of an alternative exemplary embodiment of a packaging assembly having storage for hardware and accessories in accordance with the present Disclosure.

Referring now to FIG. 24, there is shown an illustrative embodiment of a packaging assembly 240 having a storage area 241 for accessories or non-suspended articles providing desirable packaging properties.

Figure 25:
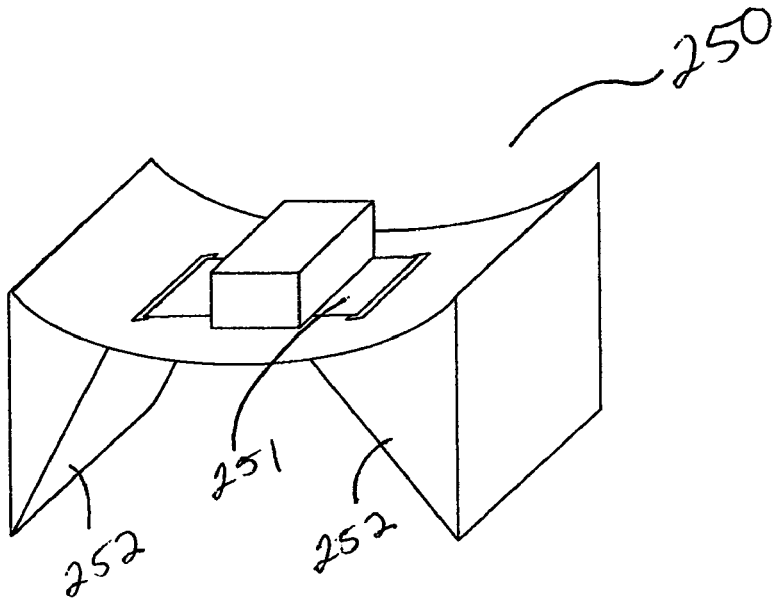
FIG. 25 is a perspective view of an alternative exemplary embodiment of a packaging assembly having angled portions in accordance with the present Disclosure.

Referring now to FIG. 25, there is shown an illustrative embodiment of a packaging assembly 250 having an angled portions 252 with locking tabs 251 thereby providing additional means for determining the characteristics of the suspension providing desirable packaging properties.

Figure 26:
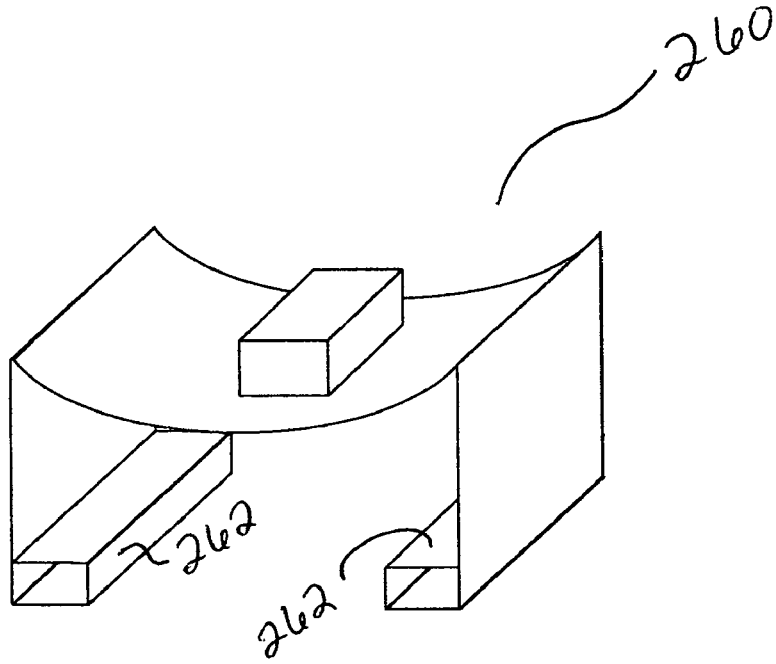
FIG. 26 is a perspective view of an alternative exemplary embodiment of a packaging assembly having structural features in accordance with the present Disclosure.

Referring now to FIG. 26, there is shown an illustrative embodiment of a packaging assembly 260 having structural beams 262 for providing structural integrity to the container and preventing lateral bending within the packaging assembly 260 and providing desirable packaging properties.

Figure 27A:
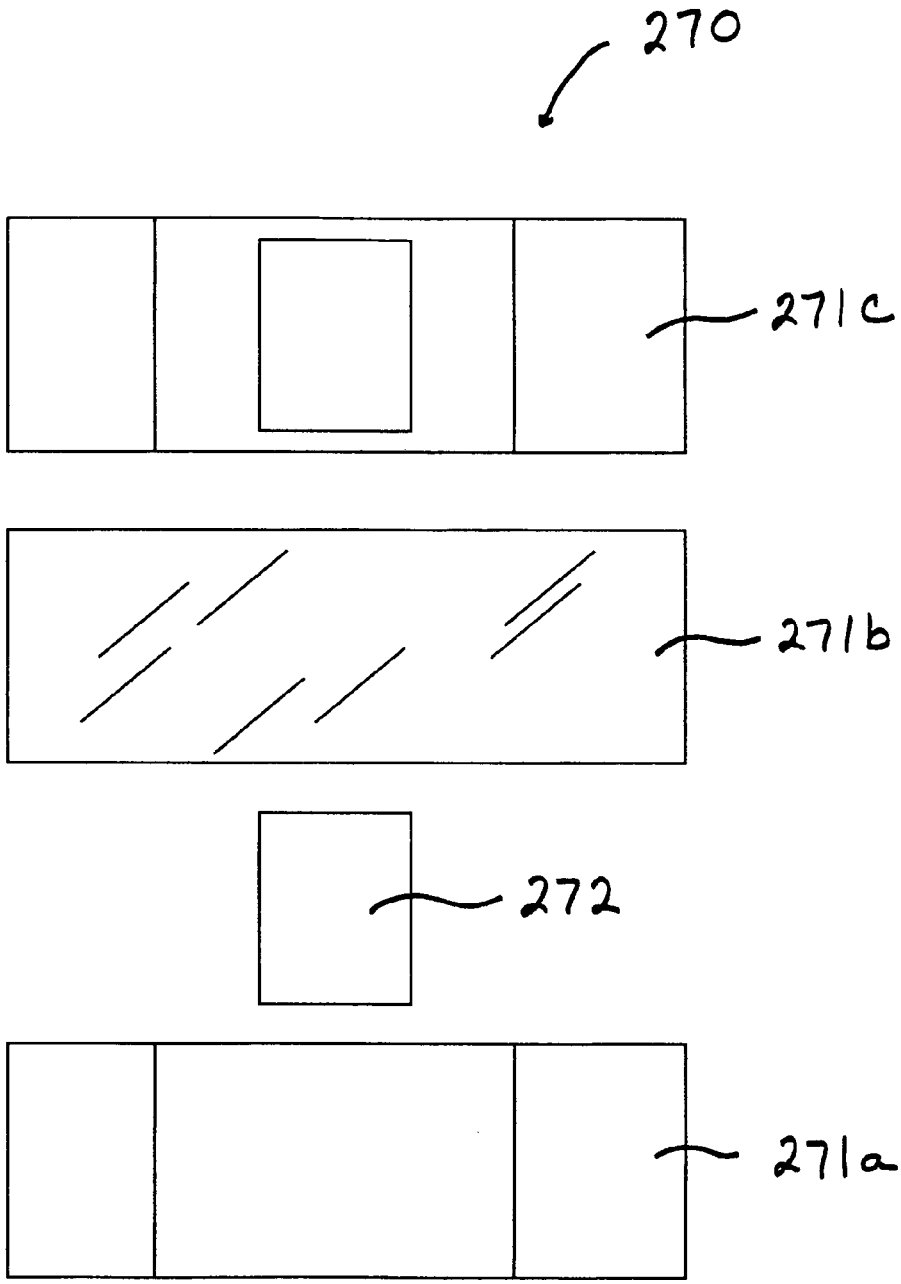
FIG. 27*a* is a top view of a packaging assembly showing assembly members side by side in accordance with the present Disclosure.

Referring now to FIG. 27*a*, there is shown a top view of an illustrative embodiment of a packaging assembly 270. The top view of the packaging assembly members, 271*a*, 271*b*, 271*c* are laid flat, and article 272, and arranged side-by-side for allowing comparison between members. The packaging assembly members represented in FIG. 27*a* can be readily stored in a flat and stacked relationship allowing for efficient use of the space used to store, assemble, and/or ship the members until they are needed for use, or reuse. As seen in FIG. 27*a*, resilient member 271*a* may comprise article information or decorative indicia placed thereon. Retention member 271*b* and framing member 271*c* may comprise clear materials to view the decorative indicia placed on resilient member 271*a*.

Referring now to FIG. 27*a*, there is shown a top view of an illustrative embodiment of a packaging assembly 270. The top view of the packaging assembly members, 271*a*, 271*b*, 271*c* are laid flat, and article 272, and arranged side-by-side for allowing comparison between members. The packaging assembly members represented in FIG. 27*a* can be readily stored in a flat and stacked relationship allowing for efficient use of the space used to store, assemble, and/or ship the members until they are needed for use, or reuse. As seen in FIG. 27*a*, resilient member 271*a* may comprise article information, or decorative indicia placed thereon. Retention member 271*b* and framing member 271*c* may comprise clear materials or decorative indicia placed on resilient member 271*a*.

Figure 27B:
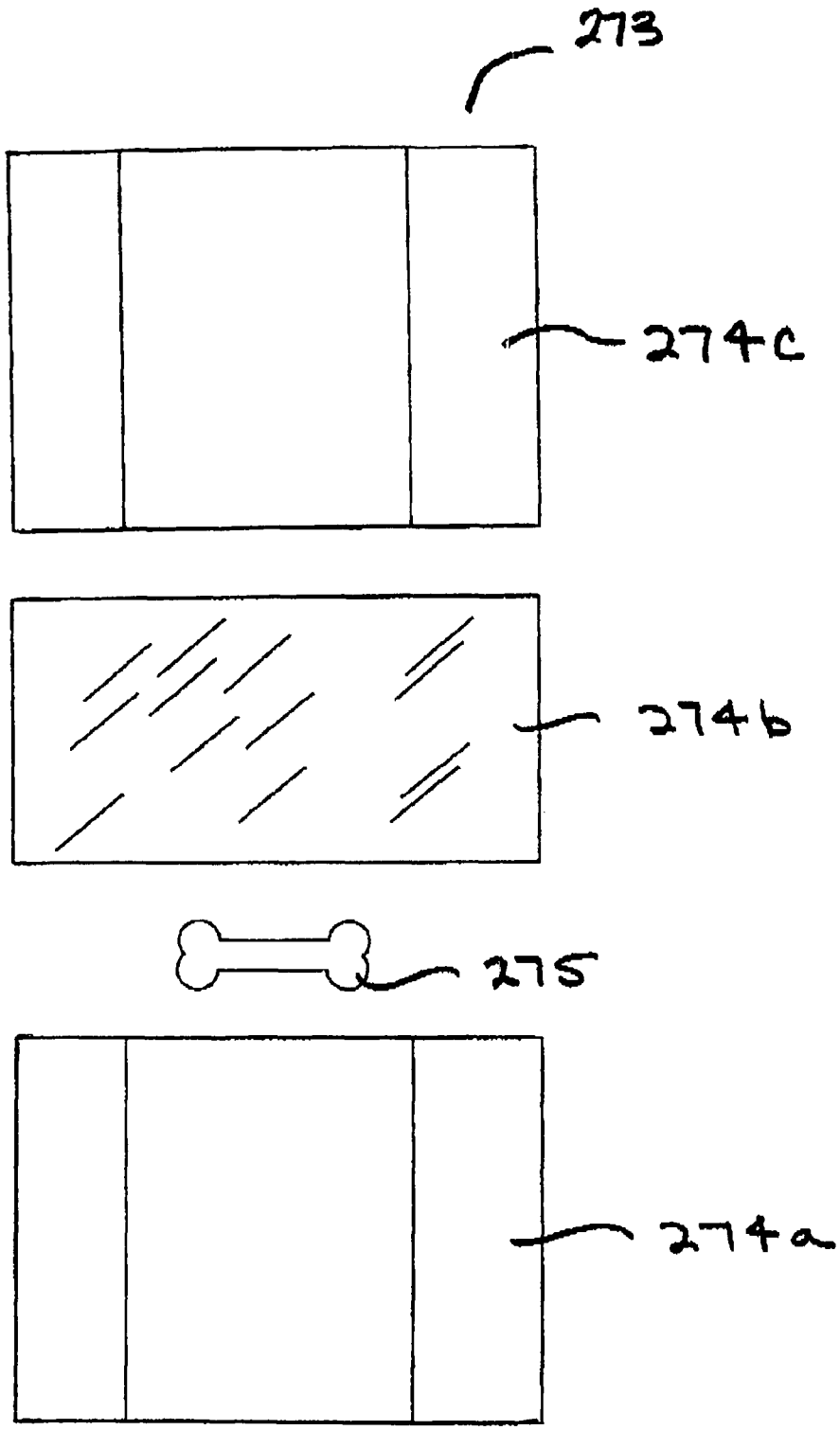
FIG. 27*b* is a top view of a packaging assembly showing assembly members side by side having decorative features in accordance with the present Disclosure.

Referring now to FIG. 27*b*, there is shown a top view of an illustrative embodiment of a packaging assembly 273. The top view of packaging assembly members, 274*a* and 274*b*, are laid flat, and article 275, and arranged side-by-side for allowing comparison between members. The packaging assembly members represented in FIG. 27*b* can be readily stored in a flat and stacked relationship allowing for efficient use of the space used to store, assemble, and/or ship the members until they are needed for use, or reuse. As seen in FIG. 27*b*, framing member 274*c* may comprise article information or decorative indicia placed thereon.

Figure 27C:
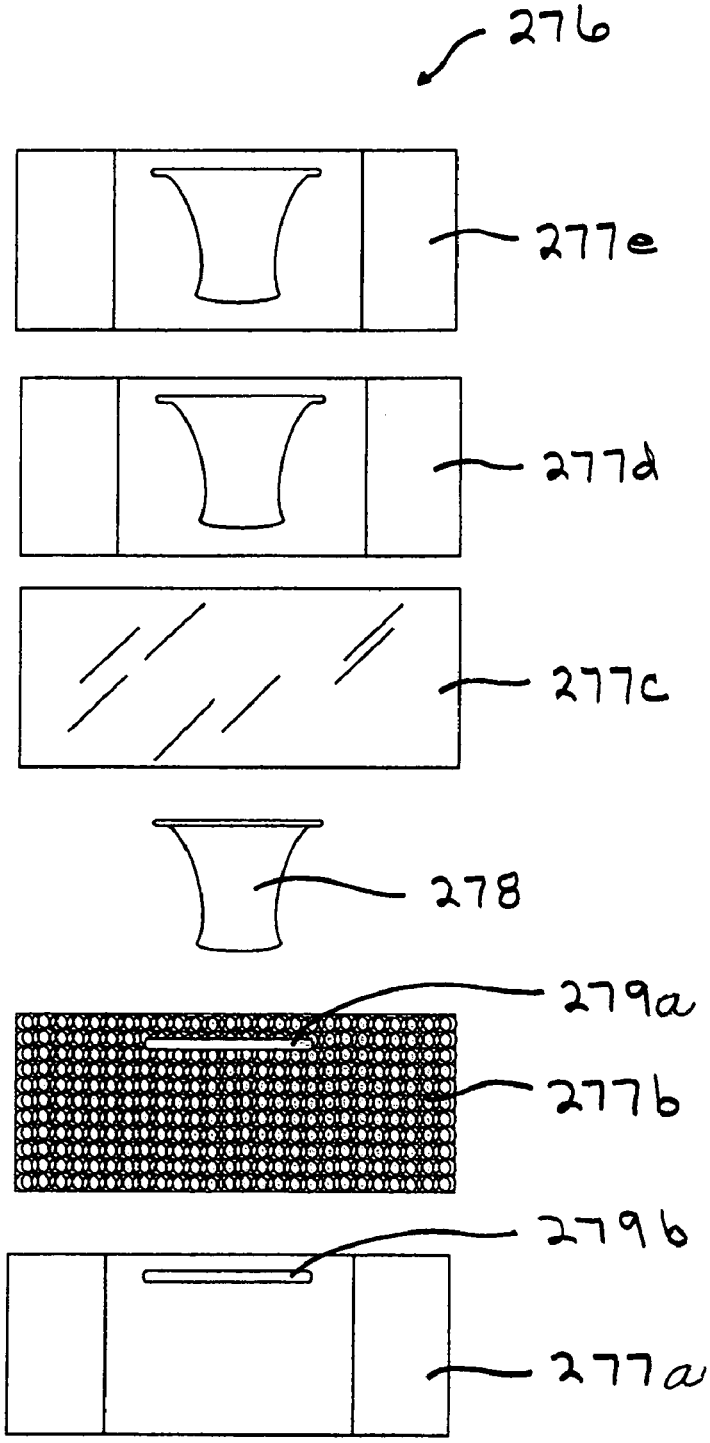
FIG. 27*c* is a top view of a packaging assembly showing assembly members side by side having decorative features, decorative, structural, cushioning, and cutouts properties in accordance with the present Disclosure.

Referring now to FIG. 27*c*, there is shown a top view of an illustrative embodiment of a packaging assembly 276. The top view of packaging assembly members, 277*a*, 277*b*, 277*c*, 277*d*, 277*e* are laid flat, and article 278, and arranged side-by-side for allowing comparison between members. As seen in FIG. 27*c*, the packaging assembly 276 may comprise a printing member 277*d*. Those skilled in the art will be able to choose different materials with different properties when desired in accordance with this disclosure. Absorption assembly member 277*b* dampens and absorbs forces adding additional protection for fragile articles. Assembly members 277*a* and 277*b* may comprise cutouts 279*a* and 279*b* which aid in protecting fragile components of an article in accordance with this disclosure. The packaging assembly members represented in FIG. 27*c* can be readily stored in a flat and stacked relationship allowing for efficient use of the space used to store, assemble, and/or ship the members until they are needed for use, or reuse. When not stored flat it will be appreciated that the structures represented in package assembly 276 can be structured in accordance with those structures represented in FIG. 3.

Referring now to FIG. 27*c*, there is shown a top view of an illustrative embodiment of a packaging assembly 276. The top view of packaging assembly members, 277*a*, 277*b*, 277*c*, 277*d*, 277*e* are laid flat, and article 278, and arranged side-by-side for allowing comparison between members. As seen in FIG. 27*c*, the packaging assembly 276 may comprise a printing assembly member 277*d*. Those skilled in the art will be able to choose different materials with different properties when desired in accordance with this disclosure. Absorption assembly member 277*b* dampens and absorbs forces adding additional protection for fragile articles. Assembly members 277*a* and 277*b* may comprise cutouts 279*a* and 279*b* which aid in protecting fragile components of an article in accordance with this disclosure. The packaging assembly members represented in FIG. 27*c* can be readily stored in a flat and stacked relationship allowing for efficient use of the space used to store, assemble, and/or ship the members until they are needed for use, or reuse.

Figure 28A:
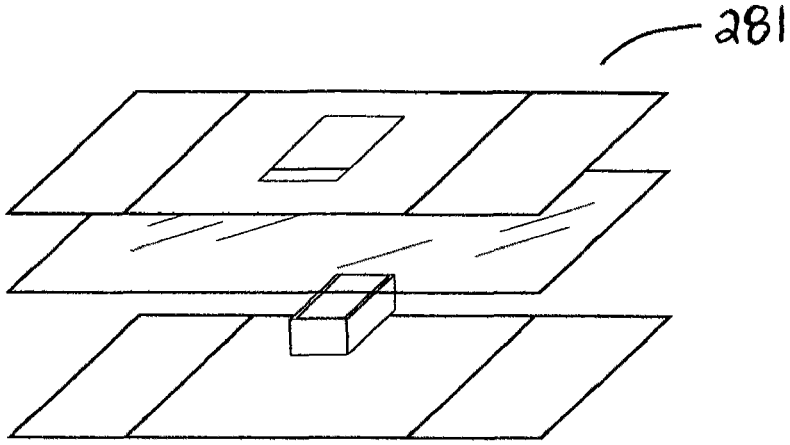
FIG. 28*a* is a perspective view of a packaging assembly in accordance with the present Disclosure.

Referring now to FIG. 28*a*, there is shown an illustrative embodiment of a packaging assembly 281 similar to those represented in FIG. 27*a* shown arranged ready for receiving an article to be safely stored and/or shipped.

Figure 28B:
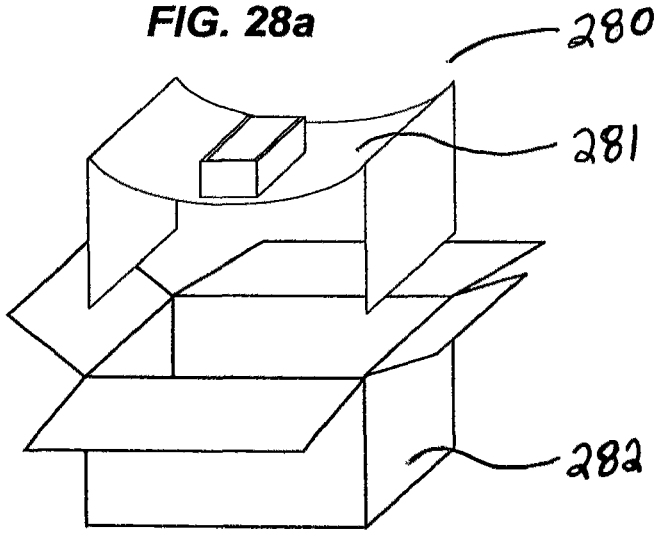
FIG. 28*b* is a perspective view of a packaging assembly and container in accordance with the present Disclosure.

Referring now to FIG. 28*b*, there is shown an illustrative embodiment of package assembly 280 with the packaging assembly 281 represented in FIG. 28*a* in an exploded view showing a typical fitment of structures inside of a container 282.

Figure 28C:
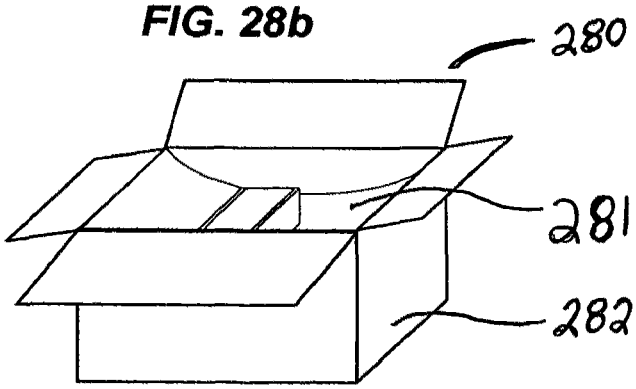
FIG. 28*c* is perspective view of a packaging assembly which is positioned inside a container in accordance with the present Disclosure.

Referring now to FIG. 28*c*, there is shown an illustrative embodiment of a package assembly 280, which is ready to be sealed for storage or shipment, which includes packaging assembly 281 and container 282 structures from FIGS. 28*a*-28*c*.

Figure 29:
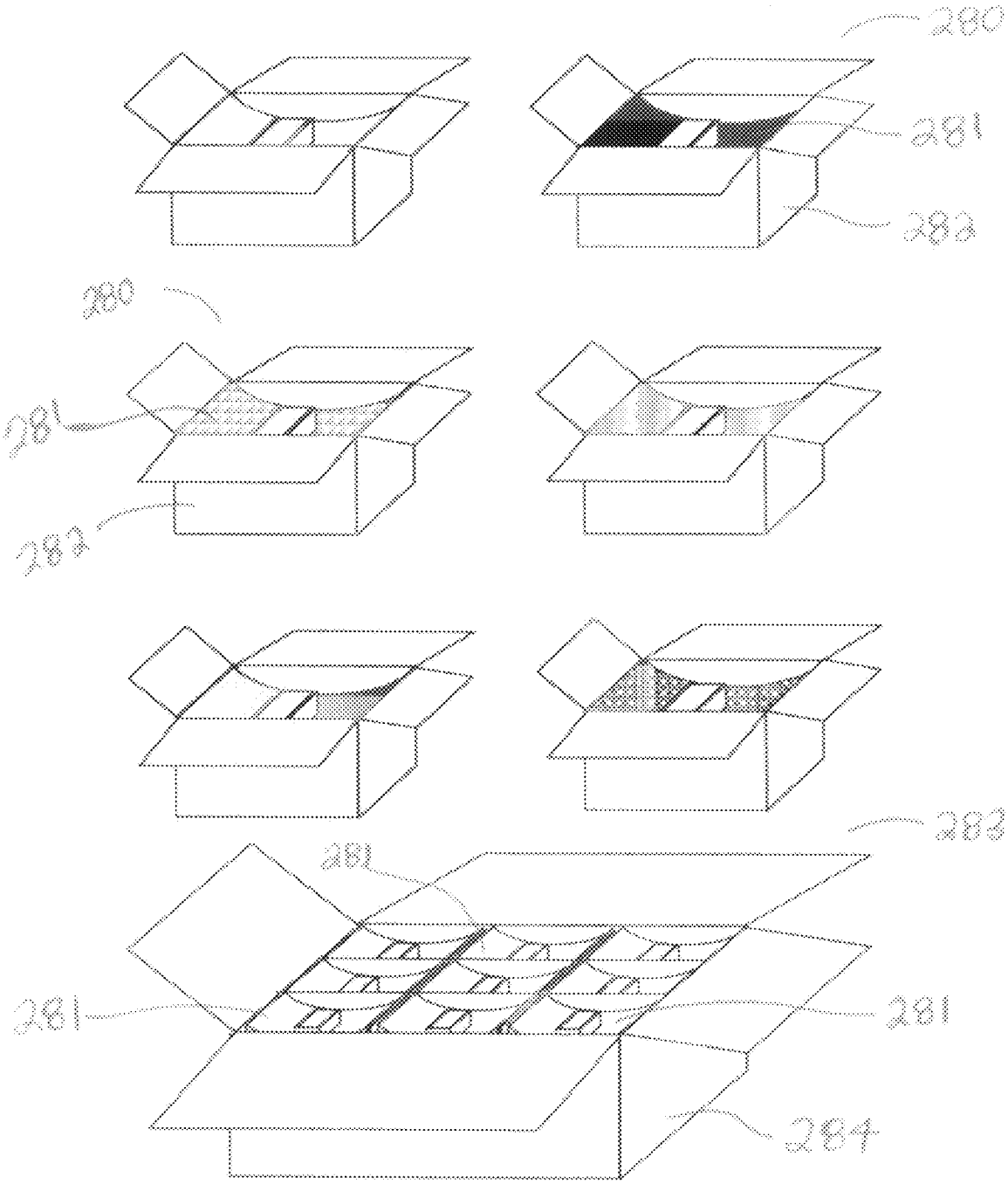
FIG. 29 is a perspective view of a variety of exemplary embodiments of single and bulk package assemblies with a single packaging assembly and a plurality of packaging assemblies respectively in accordance with the present Disclosure.

Referring now to FIG. 29, there are shown illustrative embodiments of package assemblies 280 and 283 in correspondence to the present disclosure are represented. Package assembly 280 representing various decorative aspects of the packaging assembly 281, and may include a single packaging assembly inside container 282 or as shown in package assembly 283 a plurality of packaging assemblies 281 inside container 284. Decorative aspects may include color, texture, and prints, or arrangements of a single packaging assembly 281 inside a container 282, or arranged in bulk inside container 284, or arranged inside a container for display as indicated above in connection with FIG. 10.

Figure 30A:
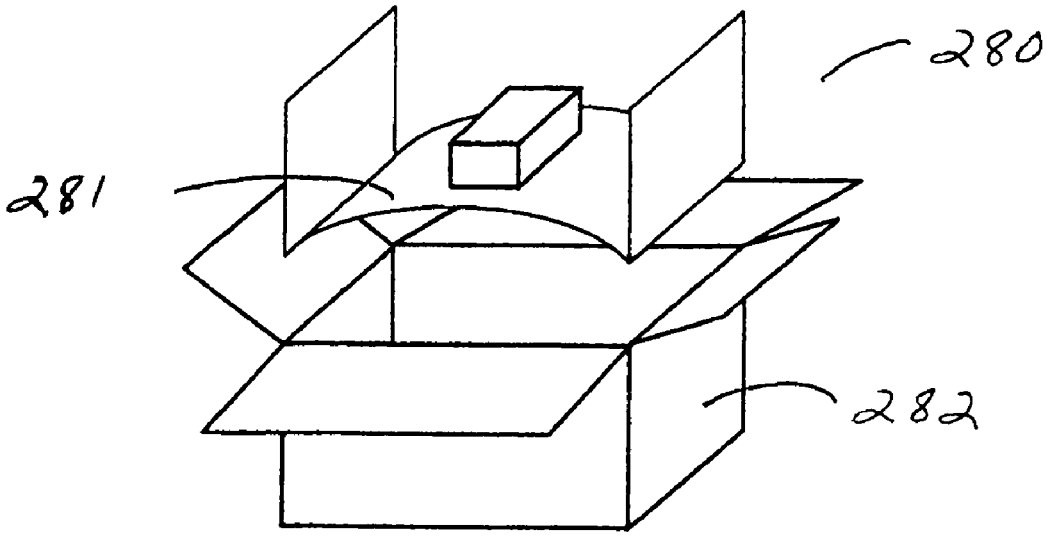
FIG. 30*a* is a perspective view of a package assembly with an inverted packaging assembly and container in accordance with the present Disclosure.

Referring now to FIG. 30*a*, there is shown an illustrative embodiment of package assembly 280 with arched member 281 shown in expanded view ready to be inserted in an arched up configuration into a container 282.

Figure 30B:
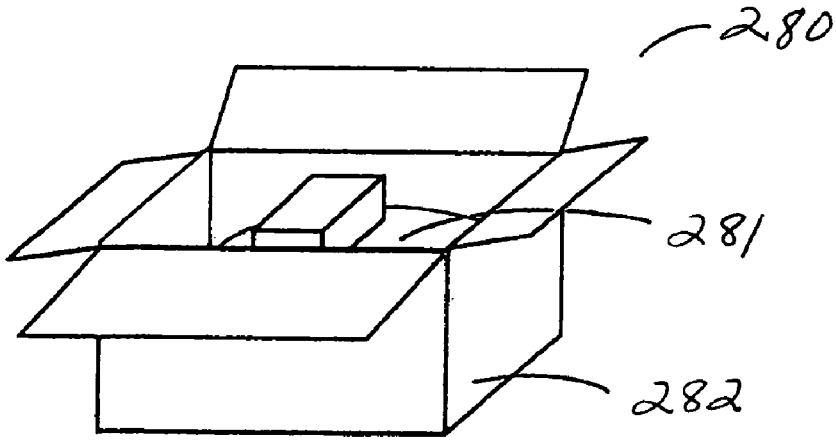
FIG. 30*b* is a perspective view of a package assembly with an inverted packaging assembly which is positioned inside a container in accordance with the present Disclosure.

Referring now to FIG. 30*b*, there is shown an illustrative embodiment of a package assembly 280 ready to be closed with the arched member 281 in an arched up configuration similar to the structures of FIG. 30*a* inside container 282.

Figure 31:
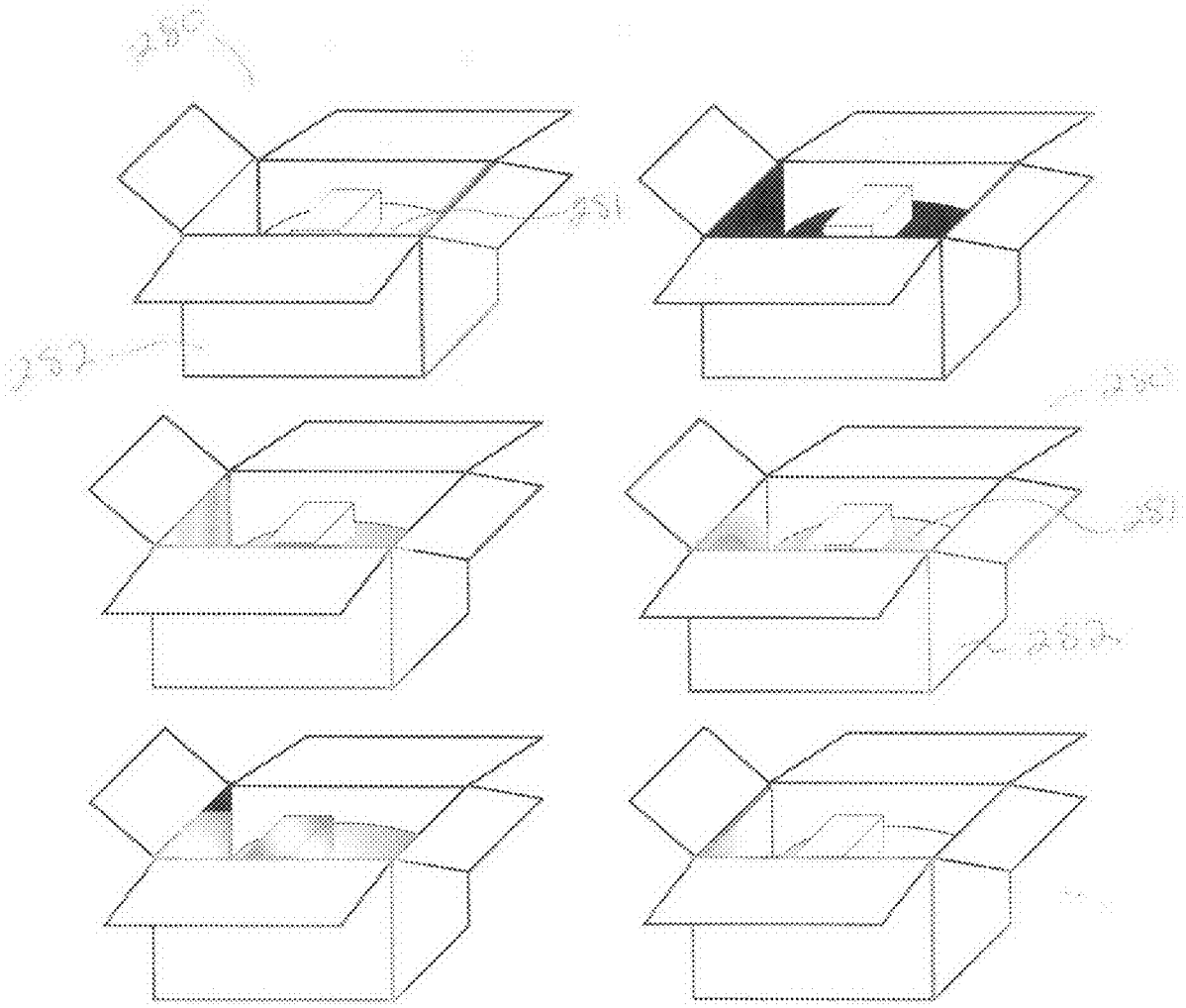
FIG. 31 is a perspective view of a variety of exemplary embodiments of a package assembly with an inverted packaging assembly in accordance with the present Disclosure.

Referring now to FIG. 31, there are shown alternative illustrative embodiments of package assemblies 280 similar to the structures of FIGS. 30*a*-30*b* in accordance with the present disclosure. Package assemblies 280, with arched member 281 inverted inside container 282, and illustrating various potential decorative aspects of the packaging assembly 281. Decorative aspects of packaging assembly 281 may include color, texture, prints, and a singular arrangement within a container 282, or a plurality arrangement within a bulk container or display container as indicated above in FIG. 29 and FIG. 10 respectively.

In view of the foregoing, those having ordinary skill in the relevant art will appreciate the advantages provided by the features of the present disclosure. Those advantages comprising; cost savings, economy of storage, and the ability to fine-tune the properties of the packaging.

In the foregoing Detailed Description, various features of the present disclosure are grouped together in single embodiments for the purpose of streamlining the disclosure. This method of disclosure is not to be interpreted as reflecting an intention that the claimed disclosure requires more features than are expressly recited in each claim hereinafter presented. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A package assembly, comprising:

a container having a bottom surface connected to a first inside side panel opposite a second inside side panel; and an arched member for holding an article inside of the container;

wherein the arched member is comprised of a generally planar material that is shaped into an arched state defined at its outer periphery by a first substantially linear side opposite a second substantially linear side and a first arched curve opposite a second arched curve, the first and the second arched curves connecting the first and the second substantially linear sides, said arched member, except for the first and the second substantially linear sides, lying substantially outside of a plane containing the first and the second substantially linear sides; and wherein at least one of the first and the second substantially linear sides is substantially adjacent one of the first and the second inside side panels;

wherein the first substantially linear side is supported by a first vertical support, the second substantially linear side is supported by a second vertical support, and the first and the second vertical supports are substantially perpendicular to the bottom surface;

wherein the first substantially linear side is integrally formed with the first vertical support and the second substantially linear side is integrally formed with the second vertical support; and wherein at least one of the first and the second vertical supports is fixedly attached to at least one of the first and the second inside panels.

2. The package assembly of claim 1 wherein at least one of the first and the second substantially linear sides contacts one of the first and the second inside side panels.

3. The package assembly of claim 1 wherein the arched member is held in the arched state by the first and the second inside side panels.

4. The package assembly of claim 1 wherein the generally planar material is pre-tensioned for suspending the article inside of the container.

5. The package assembly of claim 1 wherein the first and the second vertical supports are sized so as to substantially correspond to a height of the first and the second inside side panels.

6. The package assembly of claim 1 wherein the first and the second substantially linear sides are integrally formed with the first and the second vertical supports proximate the bottom surface.

7. The package assembly of claim 1 wherein the first and the second substantially linear sides are integrally formed with the first and the second vertical supports distant from the bottom surface.

8. The package assembly of claim 1 further comprising an arched member bottom surface that connects the first vertical support to the second vertical support.

9. The package assembly of claim 1 wherein the arched member is not supported in the plane except by support of the first and the second substantially linear sides.

10. The package assembly of claim 9 wherein the arched member is only supported at the first and the second substantially linear sides.

11. The package assembly of claim 1 wherein the arched member is comprised of a resilient member and a retention member.

12. The package assembly of claim 11 wherein the arched member is further comprised of a frame member.

13. The package assembly of claim 11 wherein the resilient member is comprised of two or more layers of a resilient material.

14. The package assembly of claim 11 wherein the retention member is comprised of two or more layers of a retention material.

15. The package assembly of claim 1 further comprising an article of manufacture held inside the container by the arched member.

16. The package assembly of claim 15 wherein the arched member has an arched contour that is anomalous to a contour of the article without a significant load bearing area contacting the article.

17. A package assembly, comprising:

a container having a bottom surface connected to a first inside side panel opposite a second inside side panel; and an arched member for holding an article inside of the container;

wherein the arched member is comprised of a generally planar material that is shaped into an arched state defined at its outer periphery by a first substantially linear side opposite a second substantially linear side and a first arched curve opposite a second arched curve, the first and the second arched curves connecting the first and the second substantially linear sides, said arched member, except for the first and the second substantially linear sides, lying substantially outside of a plane containing the first and the second substantially linear sides; and wherein at least one of the first and the second substantially linear sides is substantially adjacent one of the first and the second inside side panels;

wherein the first substantially linear side is supported by a first vertical support, the second substantially linear side is supported by a second vertical support, and the first and the second vertical supports are substantially perpendicular to the bottom surface;

wherein the first substantially linear side is integrally formed with the first vertical support and the second substantially linear side is integrally formed with the second vertical support; and wherein at least one of the first and the second vertical supports is removably attached to at least one of the first and the second inside panels.

18. The package assembly of claim 17 wherein at least one of the first and the second substantially linear sides contacts one of the first and the second inside side panels.

19. The package assembly of claim 17 wherein the arched member is held in the arched state by the first and the second inside side panels.

20. The package assembly of claim 17 wherein the generally planar material is pre-tensioned for suspending the article inside of the container.

21. The package assembly of claim 17 wherein the first and the second vertical supports are sized so as to substantially correspond to a height of the first and the second inside side panels.

22. The package assembly of claim 17 wherein the first and the second substantially linear sides are integrally formed with the first and the second vertical supports proximate the bottom surface.

23. The package assembly of claim 17 wherein the first and the second substantially linear sides are integrally formed with the first and the second vertical supports distant from the bottom surface.

24. The package assembly of claim 17 further comprising an arched member bottom surface that connects the first vertical support to the second vertical support.

25. The package assembly of claim 17 wherein the arched member is not supported in the plane except by support of the first and the second substantially linear sides.

26. The package assembly of claim 25 wherein the arched member is only supported at the first and the second substantially linear sides.

27. The package assembly of claim 17 wherein the arched member is comprised of a resilient member and a retention member.

28. The package assembly of claim 27 wherein the arched member is further comprised of a frame member.

29. The package assembly of claim 27 wherein the resilient member is comprised of two or more layers of a resilient material.

30. The package assembly of claim 27 wherein the retention member is comprised of two or more layers of a retention material.

31. The package assembly of claim 17 further comprising an article of manufacture held inside the container by the arched member.

32. The package assembly of claim 31 wherein the arched member has an arched contour that is anomalous to a contour of the article without a significant load bearing area contacting the article.

* * * * *